US009441183B1

(12) United States Patent
Bulluck et al.

(10) Patent No.: US 9,441,183 B1
(45) Date of Patent: Sep. 13, 2016

(54) WASH-OUT RESISTANT UNDERWATER GREASE

(71) Applicant: Texas Research International, Inc., Austin, TX (US)

(72) Inventors: John Werner Bulluck, Spicewood, TX (US); Nathan C. Hoppens, Austin, TX (US)

(73) Assignee: TEXAS RESEARCH INTERNATIONAL, INC., Austin, TX (US)

( * ) Notice: Subject to any disclaimer, the term of this patent is extended or adjusted under 35 U.S.C. 154(b) by 29 days.

(21) Appl. No.: 14/121,757

(22) Filed: Oct. 15, 2014

Related U.S. Application Data

(60) Provisional application No. 61/904,226, filed on Nov. 14, 2013.

(51) Int. Cl.
*C10M 169/04* (2006.01)

(52) U.S. Cl.
CPC ..... *C10M 169/044* (2013.01)

(58) Field of Classification Search
CPC ..... C10M 169/044
See application file for complete search history.

(56) References Cited

U.S. PATENT DOCUMENTS

| | | | | |
|---|---|---|---|---|
| 7,323,435 | B1 * | 1/2008 | Turri | C08G 18/0814 508/446 |
| 8,758,876 | B2 * | 6/2014 | Carcagno | C09D 163/00 252/387 |
| 2007/0213240 | A1 * | 9/2007 | Shimura | C10M 105/54 508/588 |

* cited by examiner

*Primary Examiner* — Cephia D Toomer
(74) *Attorney, Agent, or Firm* — Jackson Walker LLP

(57) ABSTRACT

A novel lubricating grease that is useful for underwater applications is made up of lubricating oil that contains a co-polymer of a hydrocarbon backbone for promoting good adhesion and a fluorine containing backbone for promoting lubricity. The grease formulation is resistant to water wash-out and does not off-gas toxic compounds. In addition to the lubricating oil, the grease formulation includes fumed silica, and may contain one or more corrosion inhibitors, an extreme pressure filler such as boron nitride, and optionally one or more polyurethane initiators.

16 Claims, 35 Drawing Sheets

Method ASTM D-2266 1200 RPM, 40 kg Load, 75°C, 1 Hour
Wear Scar = 0.54 mm Grand Average = 0.108 Y-O Intercept = 0.109

Method ASTM D-2266 1200 RPM, 40 kg Load, 75°C, 1 Hour
Wear Scar = 0.77 mm Grand Average = 0.060 Y-O Intercept = 0.071

Method ASTM D-2266 1200 RPM, 40 kg Load, 75°C, 1 Hour
Wear Scar = 1.99 mm Grand Average = 0.157 Y-O Intercept = 0.127

Method ASTM D-2266 1200 RPM, 40 kg Load, 75°C, 1 Hour
Wear Scar = 0.72 mm Grand Average = 0.128 Y-O Intercept = 0.127

WASH-OUT RESISTANT UNDERWATER GREASE

This application claims priority to U.S. Provisional Patent Application Ser. No. 61/904,226, entitled "Wash-out Resistant Underwater Grease," filed Nov. 14, 2013, the entire content of which is hereby incorporated by reference.

This invention was made with government support under Grant No. N65538-08-M-0075 awarded by the U.S. Navy, NAVSEA. The government has certain rights in this invention.

BACKGROUND

The present disclosure pertains to lubricating greases that are useful and effective in underwater applications, that are resistant to water wash-out, and that do not off-gas toxic volatile compounds.

Specialized underwater structures, such as submarine hangar areas, have actuated parts, such as dry dock shelter operating hatches and other hatches and doors, that must be adequately lubricated to ensure long service-life. There is an ongoing need to develop a new lubricating grease resistant to seawater washout and free from harmful gases that can leach out into the breathable airspace. Greases that are resistant to water washout are usually petroleum byproduct based and off-gas high levels of substances that are deemed harmful. Many fluorocarbon based greases that do not leach out any dangerous gases do not stick to the steel submarine hatches, and wash away when flushed with seawater. Previous and current commercial, government, and military applications have used certain hydrocarbon-based greases (including Termalene®, Bel-Ray Company, Inc., Farmingdale, N.J.). However, these greases have been found to off-gas toxic compounds such as isopropanol and low molecular weight hydrocarbons in pressurized environments, making them unacceptable for use in the high pressure environments (up to six atm) and enclosed areas encountered in diving operations. To ensure diver safety in these operations, fluorocarbon-based greases (including DuPont Krytox® 240AC, DuPont Fluoroproducts, Wilmington, Del. and Halocarbon 25-5S, Halocarbon Products Corp., River Edge, N.J.), which do not off-gas toxic compounds are utilized. While the lubrication performance of these materials is exceptional, the resistance to seawater washout is very low, necessitating constant and costly reapplication of the lubricant.

The performance of fluorocarbon-based lubricants comes at a premium price, which can be $100/oz or higher, depending on the material. Coupled with the high rate of seawater washout, the continued use of these products is a significant cost in terms of money spent on maintenance. In addition to the high material cost, specialized underwater structures such as submarines must also spend more time in maintenance while the grease is constantly reapplied. The resultant costs in terms of both time and money while these structures are out of service must be mitigated. To rectify this situation, a grease formulation that is safe for underwater operations such as diving (does not off-gas toxic compounds), delivers high lubrication performance (at least equal to that of the currently used fluorocarbon-based greases), and is resistant to seawater washout is actively being sought.

SUMMARY

The present disclosure pertains to lubricating greases showing high effectiveness in underwater applications which are resistant to water wash-out and do not off-gas toxic materials.

Novel lubricating oils based on copolymers of hydrocarbons and fluorocarbons or perfluoropolyethers (PFPE) were first synthesized. The resultant oils were used in combination with solid particulate fillers (Teflon and hydrophobic fumed silica) to formulate different greases for evaluation. In particular, the innovative grease development approach utilized a fluorohydrocarbon base oil in conjunction with a thixotropic filler or thickener and various anti-corrosion additives. A variety of materials were evaluated, numerous formulations were developed, and in conjunction with the experimental design development process, preferred formulations were identified. Preferred formulations contain boron nitride for added extreme pressure resistance. Several fluorocarbon and hydrocarbon starting compounds which could be combined to produce a fluorohydrocarbon oil using a small amount of tin and/or tertiary amine catalyst and heat were also identified. The optimized formulation performed very well in the testing program, it was resistant to water washout, prevented corrosion both actively and passively, and passed the NAVSEA P-9290 certification for the off-gassing of volatile compounds. The grease can be applied by hand, grease gun, or grease lines. Squeeze tubes in different sizes with variable tip sizes could potentially be used, allowing for easy application in hard to reach areas. Reduced costs will be realized with this grease due to its improved durability and raw material costs. This advantage is coupled with decreased repair and application times.

Because the preferred formulations do not contain any volatile materials, virtually nothing is off-gassed when the greases are subject to the high temperature and pressure conditions of interest to certain military applications. This has been confirmed with gas chromatography/mass spectrometry (GC/MS) experiments. Both in-house and external contracted lubrication tests indicate that the grease formulations perform better than the materials currently in use. For example, PFPE-based greases such as Krytox® 240AC do not efficiently adhere to or wet steel surfaces. This phenomenon is likely to contribute to the poor water washout resistance of Krytox® 240AC. As discussed below, the ASTM standard method for grease resistance to water washout (ASTM D-1264) was ultimately inconclusive. However, internal testing has demonstrated that the newly developed greases do show improvement to water washout when compared to other materials. Due to this increased resistance to water washout, a significant reduction in material and labor costs is expected. A Cost/Benefit analysis has estimated cost savings of over $650,000 during a ten-year period with this newly developed technology.

Initial phases of development focused primarily on internal synthesis of novel lubricating oils based upon copolymers of fluorocarbon and hydrocarbon chains. These novel oils have been utilized with solid particulate filler materials in order to formulate 20 different greases. The major lubrication screening test has been done in-house utilizing a Falex Pin and Vee-Block tester and a modified version of test method ASTM D2625. In-house testing for off-gassing has also been performed on candidate grease formulations. The most promising candidates were sent for water wash-out (ASTM D-1264) testing and 4-ball wear (ASTM D-2266) testing. Several greases were formulated that performed excellent in both in-house and external testing. These greases will offer an excellent alternative to those currently in use.

As development progressed, preferred formulations of the new underwater, diver safe lubricating grease was pursued by the formulation of fumed silica filled polymeric hydrofluorocarbon oil. There are COTS (commercial of the shelf)

fluorocarbons that do not off-gas any dangerous compounds, but these fluorocarbons have the propensity to wash away in seawater. It appears that a viable method for combining these fluorocarbon base oils with hydrocarbon end groups has been discovered for producing a hybrid grease oil that acts a hydrocarbon grease in sticking or adhering to the hatch while not producing the dangerous off-gas materials that other greases do. In the present grease there is an A and B component for the base oil. The B component contains the fluorine containing backbone that promotes lubricity without off gasing dangerous chemicals. And the A component contains the hydrocarbon backbone that promotes good adhesion to the steel substrates of the hatch. The new underwater, diver safe grease is non-toxic, unreactive, and inflammable. Production of the grease includes reaction of the two components at elevated temperatures followed by blending of the fillers to create a lubricating oil that acts like a grease.

Further results indicate that greases can be formulated to provide the best of both types of lubricant. The new greases can be easily applied in both manufacturing and field environments. Extensive sea water resistance testing was performed on the new greases and they performed very well. The color of the grease can also be changed to match any shade deemed desirable or necessary by the user.

Numerous materials were utilized when developing the optimized grease compositions, as shown below in Table 1. Out of the formulation evaluations the following materials functioned the best and were utilized in the optimized formulations: (1) Fluorolink™ E10H and Fluorolink™ D (Solvay Solexis, West Deptford, N.J.), (2) n-butyl isocyanate, (3) boron nitride, (4) a corrosion inhibition package (Vanlube antioxidants and anti-wear rust inhibitors, R.T. Vanderbilt, Norwalk, Conn.), (4) Aerosil® R202 fumed silica (Evonik Degussa Corporation, Parsippany, N.J.), and (5) polyurethane initiators. For formulation A2283-93 the primary fluorocarbon was Fluorolink™ E10H and prior formulations used Fluorolink™ D. The initiators evaluated were 1,4-Diazabicyclo[2.2.2]octane solution and a tertiary amine glycol mixture.

TABLE 1

| Class of Material | Function | Candidates | Manufacturer |
|---|---|---|---|
| Fluorocarbons | Polar backbone for extra lubrication with pendant hydroxide end groups for polyurethane linkage. | Fluorolink D, and Fluorolink E10H | Solvay Solexis |
| Hydrocarbons | Non-polar backbone for attraction to the steel surface with pendant isocyanate groups for polyurethane linkage. | n-butyl isocyanate | Lanxess |
| Initiators | Act as a polyurethane catalyst in an easy to mix liquid form. | Triethanol Amine | Air Products |
| Thixotropes | Filler used to build up the oil to grease consistency. | Fumed Silica | Aerosil |
| EP Additives | Improves the extreme pressure wear ability of the grease. | Boron Nitride | Momentive |
| Corrosion Additives | Improves the corrosion resistance of the grease. | Amine based corrosion inhibition package. | R. T. Vanderbilt |

Hydrofluorocarbon polymers are hybrid polymers that have a carbon-fluorine backbone and a carbon-hydrogen backbone, as shown in FIG. 1. It's the difference in electronegativities of the two different side groups that account for the diverse range of physical properties in this unique lubrication oil. During the reaction of the fluorocarbon glycol with the short chain hydrocarbon isocyanate, a physical link forms between the two substituents forming a final product that acts as both a polar and non-polar liquid. To promote adhesion to the steel substrate, the non polar hydrocarbon tail groups use hydrogen bonding to attach the grease to the substrate. This ensures the grease does not simply wash away when exposed to rushing seawater. The fluorocarbon body of the polymer chains is very polar, and helps the lubricating oil polymer chains to slide past one another, creating a very good lubricating substance. In developing the preferred grease formulations, a process for the accelerated curing of these coatings at slightly elevated temperatures was also developed.

The optimized grease composition uses a hydrofluorocarbon polymer fluid as a lubricant useful well above ambient temperatures seen in the field. This polymer fluid reacts overnight at slightly elevated temperatures of 70° C. Addition of boron nitride to the formulation provides stability and increased lubricity at extreme pressure due to its plate-like structure, as seen in FIG. 2. The grease composition utilizes a fumed silica thixotrope that provides a matrix for the lubricating oil to reside. This hydrophobic matrix gives body to the liquid and produces a lubricating grease for use in an underwater system. Excellent corrosion resistance, thermal stability, and washout resistance were exhibited by this new hydrofluorocarbon grease composition without the dangerous off-gassing results found in other hydrocarbon greases that do not washout.

Throughout the development of the grease formulations, various lubricating oils were synthesized based on block copolymers of hydrocarbon and fluorocarbon chains. Traditional synthetic techniques were modified to minimize volatile byproducts/solvents that could potentially end up in the final grease formulation. When possible, the reactants were the only thing added. Given the commercially available starting materials, it was decided to utilize a carbamate (urethane) linkage as the primary means of covalently attaching the different polymer blocks. Since carbamate formation between an isocyanate and an alcohol generates no by-products, no small molecule organics are left in the oil for potential off-gassing. However, a small amount (0.1%) of tin catalyst is needed to initiate the reaction (see FIG. 3). The catalyst has a high molecular weight, such as dibutyltin dilaurate or Tin (II) 2-ethylhexanoate, and is not expected to be off-gassed under any conditions. After synthesis, the lubricating oils were purified in a vacuum oven to remove any residual un-reacted material. As seen in FIG. 3, the reaction is performed in the absence of solvent and generates no by-products for potential off-gassing.

Six different lubricating oils were synthesized by this method. Four of the six (shown in FIG. 4) are combinations of hydrocarbon isocyanates and fluorocarbon alcohols. In FIG. 4, there are varying numbers of carbon atoms in the A block of the co-polymers. All of the syntheses yielded low-viscosity, colorless oils, however, one of the oils eventually crystallized on standing. Three additional oils were prepared based on the Fluorolink™ polymer modifiers, which are organofunctionalized perfluoropolyethers (PFPE). ABA block copolymers were synthesized based on Fluorolink D and D10-H (hydroxy-terminated PFPEs) and Fluorolink E10 (a poly(ethylene glycol) terminated PFPE). The structures of the copolymers are shown in FIG. 1. The addition of the hydrocarbon chain to these fluorocarbons and PFPEs is expected to increase the resistance to seawater washout, reducing the need for costly grease replacement and saving both time and money.

In FIG. 1, the copolymers have been drawn to represent molecular orientation (the hydrocarbon ends are associating with one another). In fact, when these materials are allowed to sit at room temperature, micellar-like solutions are formed. This is likely due to the local molecular orientation. Since these lubricating oils are more viscous at room temperature than standard oils, less filler material needs to be added to the formulation to attain the requisite thickness to keep the grease in place on the substrate. This unexpected result is a benefit, since lubrication properties of greases are generally increased with decreasing amounts of filler material.

Preferred embodiments of the new grease formulation are made up of, first, a lubricating oil that is comprised of a co-polymer of a hydrocarbon isocyanate and a fluorocarbon alcohol or hydroxyl terminated perfluoropolyether. In preferred embodiments, the lubricating oil comprises those co-polymers illustrated in FIG. 1, or a co-polymer of n-butyl isocyanate and perfluoropolyether (PFPE)-ethoxylated dialcohol. In preferred embodiments of the co-polymers illustrated in FIG. 1, the carbon atoms in the A block can be anywhere from 2 to 20. In some embodiments, there are 4 carbon atoms in the A block. The lubricating oil preferably makes up about 80-95% by weight of the grease formulation. Preferred embodiments may also include fumed silica and one or more corrosion and oxidation inhibitors such as antioxidants or anti-wear rust inhibitors. These may include the antioxidant Vanlube® 961, CAS#184378-08-3, or Benzenamine, N-phenyl-, reaction products with isobutylene and 2,4,4-trimethylpentene, which is a liquid, ashless antioxidant for use in oils and greases of various types. Also, Vanlube® 7723, CAS #-10254-57-6, or 4,4'-Methylene bis (dibutyldithiocarbamate), which is a liquid, ashless high temperature antioxidant that aids in extreme pressure applications, can be used. Another compound that can be used is Vanlube® 9123, NJTSR No. 800983-5100P, which is a liquid, ashless anti-wear rust inhibitor for use in oils and greases of various types. A tertiary amine that can be used is DABCO® 33LV, CAS #-280-57-9, or 1,4-Diazabicyclo [2.2.2]octane solution in ethylene glycol. The fumed silica may make up about 5-10% by weight of the grease formulation, and the one or more corrosion and oxidation inhibitors may make up about 0.1-1.5% by weight of the grease formulation. Finally, preferred embodiments may include boron nitride, which may make up about 0.1-1% by weight of the grease formulation. Optionally, preferred embodiments may also include one or more polyurethane initiators, such as 1,4-diazabicyclo[2.2.2]octane solution or a tertiary amine glycol mixture, or more particularly, triethanolamine.

The newly developed greases can benefit dry dock shelter hatches, emergency escape hatches, as well as any other application that uses the current technology in order to reduce the quantity of different greases used in the field. The corrosive nature of salt water, water pressure, various temperature ranges, and biological life can cause problems in this area and lead to failure. An innovative grease approach was developed to utilize a thermally stable hydrofluorocarbon polymer lubricant in conjunction with hydrophobic, thixotropic fumed silica filler, extreme pressure resistant boron nitride, and also an amine based corrosion/oxidation preventative package. Several excellent performing fluorocarbon base oils were identified that could be used in conjunction with the silica filler for the water washout resistant grease. There are not many hybrid hydrocarbon/fluorocarbon functional grease compositions commercially available that do not off-gas dangerous compounds.

The initial development approach was to develop formulations based upon early compositions and examine additional hydrophobic fillers and lubricating base oil components. After this, two experimental designs were performed further examining several fluorocarbon starting materials, inorganic thixotropic fillers, and disodium sebacate, a corrosion preventative additive. Through this work a preferred composition was identified that was further defined in additional development work. This composition was tested extensively for performance properties.

This new grease has a variety of potential applications within the government, military, and other industries. It offers outstanding washout resistance coupled with limited harmful volatile products. The grease may be able to replace currently used greases, including Termalene®, in many other applications as well as the dry dock shelter hatches pending extra testing. As volatile organic compound restrictions increase in all chemical applications, greases that have the same properties as the sticky hydrocarbon greases without sacrificing washout characteristics will be needed. Research shows that it is possible to get create a grease that does not emit any VOC's under pressure in a submerged environment while not compromising on the other characteristics that make for a usable grease.

DETAILED DESCRIPTION OF PREFERRED EMBODIMENTS

Figure 1:
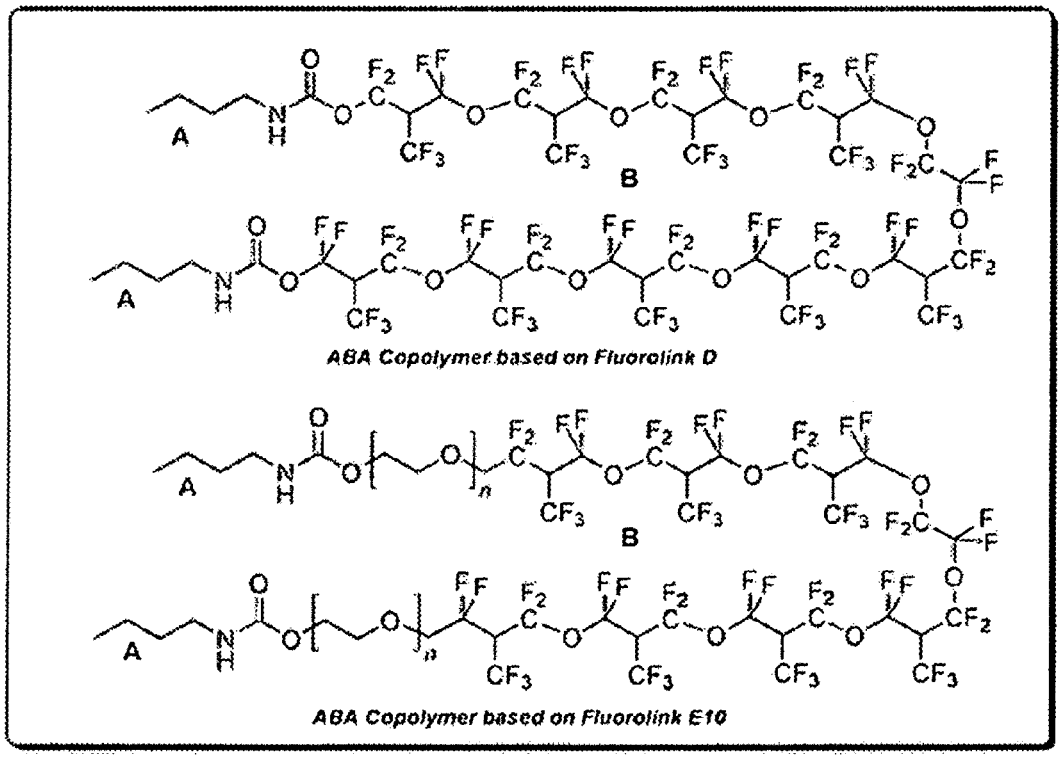
FIG. 1 shows exemplary ABA block copolymer lubricating oils based on polymer modifiers.
Figure 2:
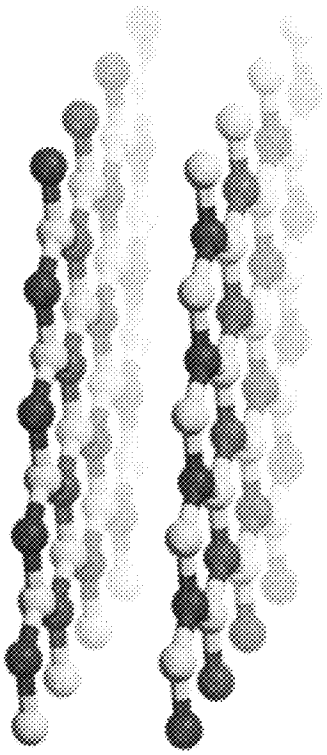
FIG. 2 shows the structure of boron nitride.
Figure 3:
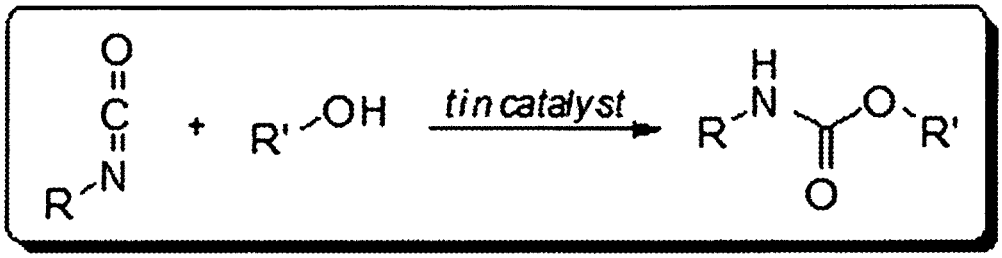
FIG. 3 shows a general synthetic scheme for the synthesis of the new lubricating oils, performed in the absence of solvent and with no by-products.
Figure 4:
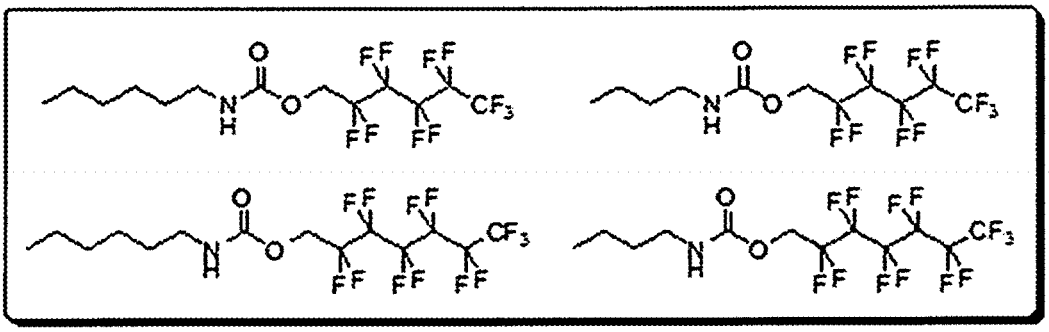
FIG. 4 shows four of the new hydrocarbon/fluorocarbon combination lubricating oils.
Figure 5:
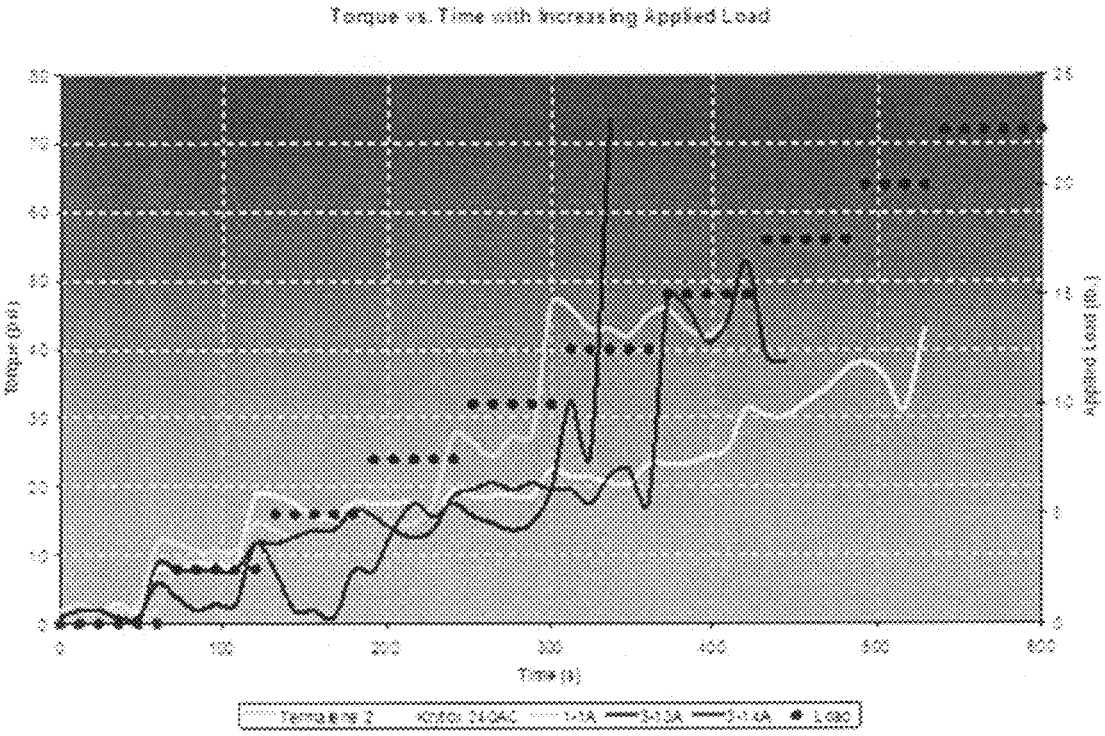
FIG. 5 shows data from in-house lubrication testing for initial screening formulations and available grease products.
Figure 6:
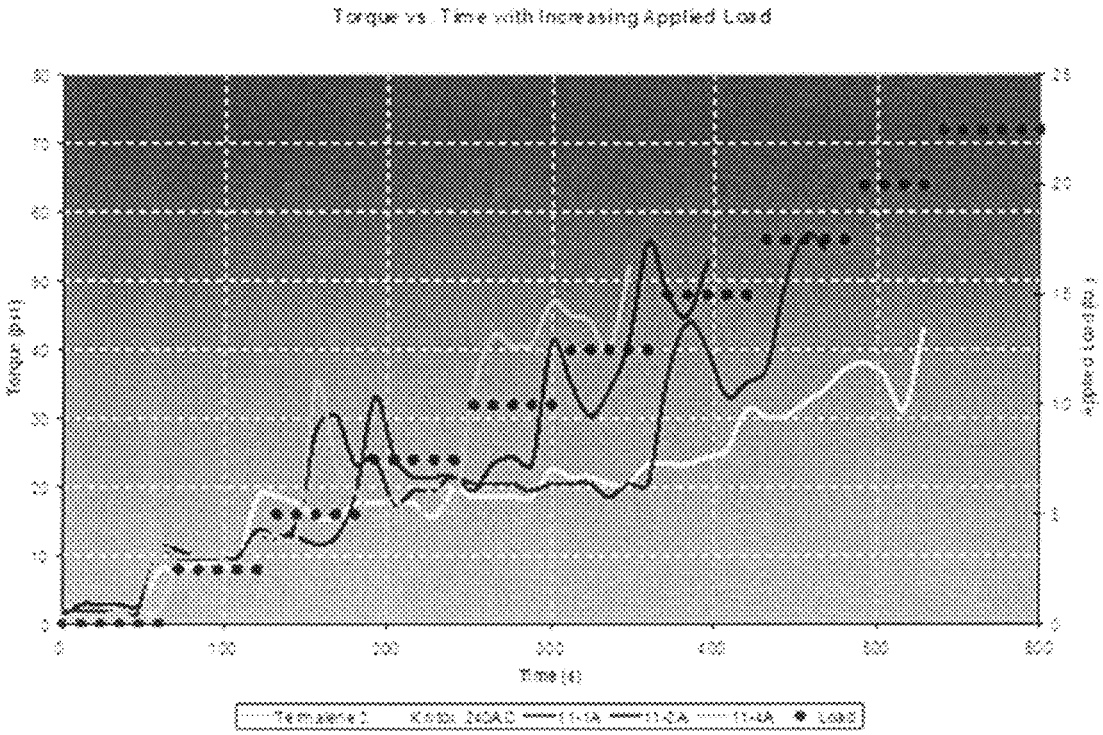
FIG. 6 shows additional data from in-house lubrication testing for initial screening formulations and available grease products.
Figure 7:
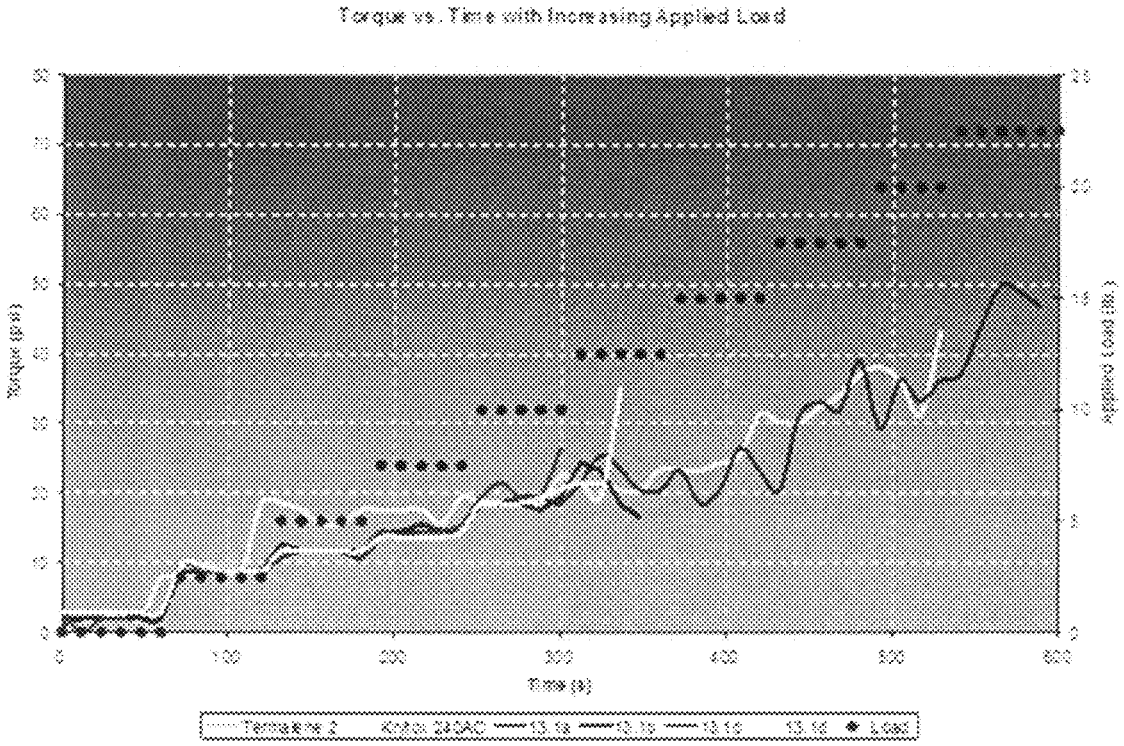
FIG. 7 shows additional data from in-house lubrication testing for initial screening formulations and available grease products.
Figure 8:
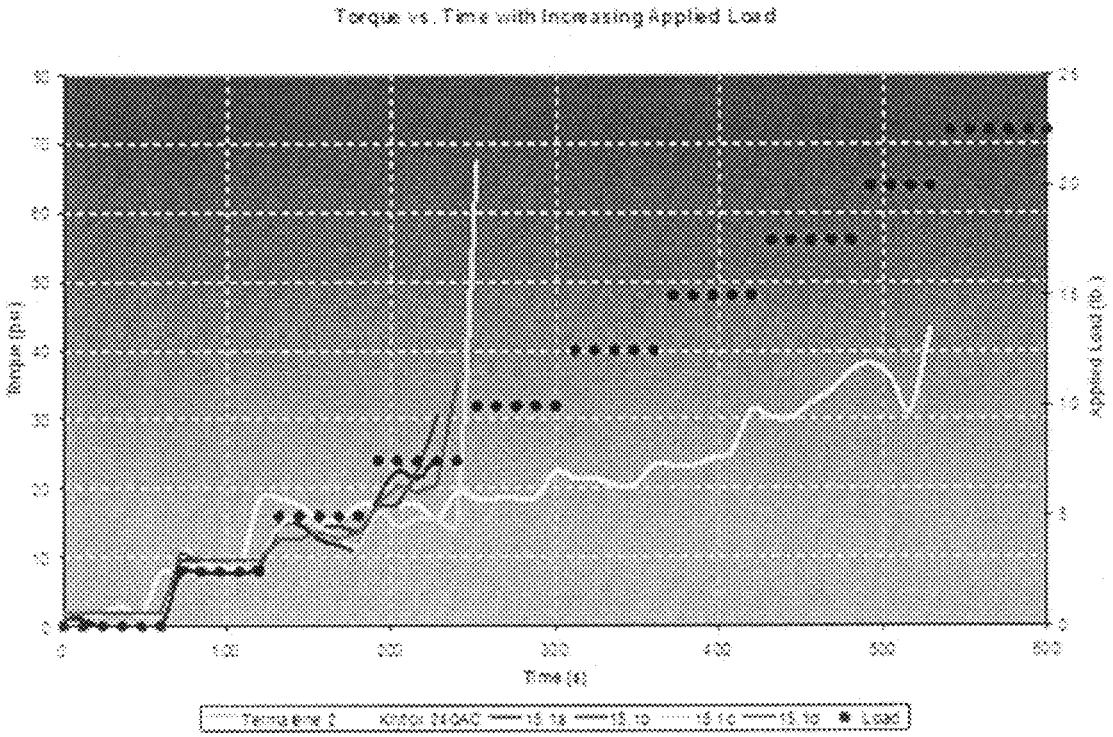
FIG. 8 shows additional data from in-house lubrication testing for initial screening formulations and available grease products.
Figure 9:
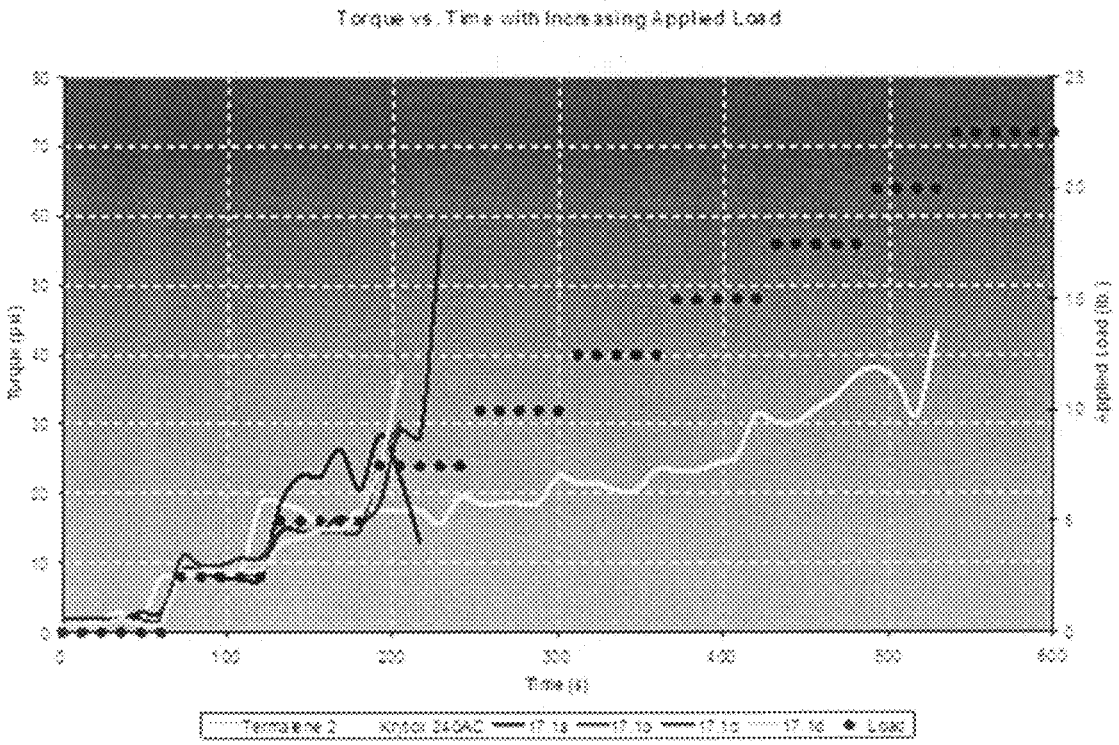
FIG. 9 shows additional data from in-house lubrication testing for initial screening formulations and available grease products.
Figure 10:
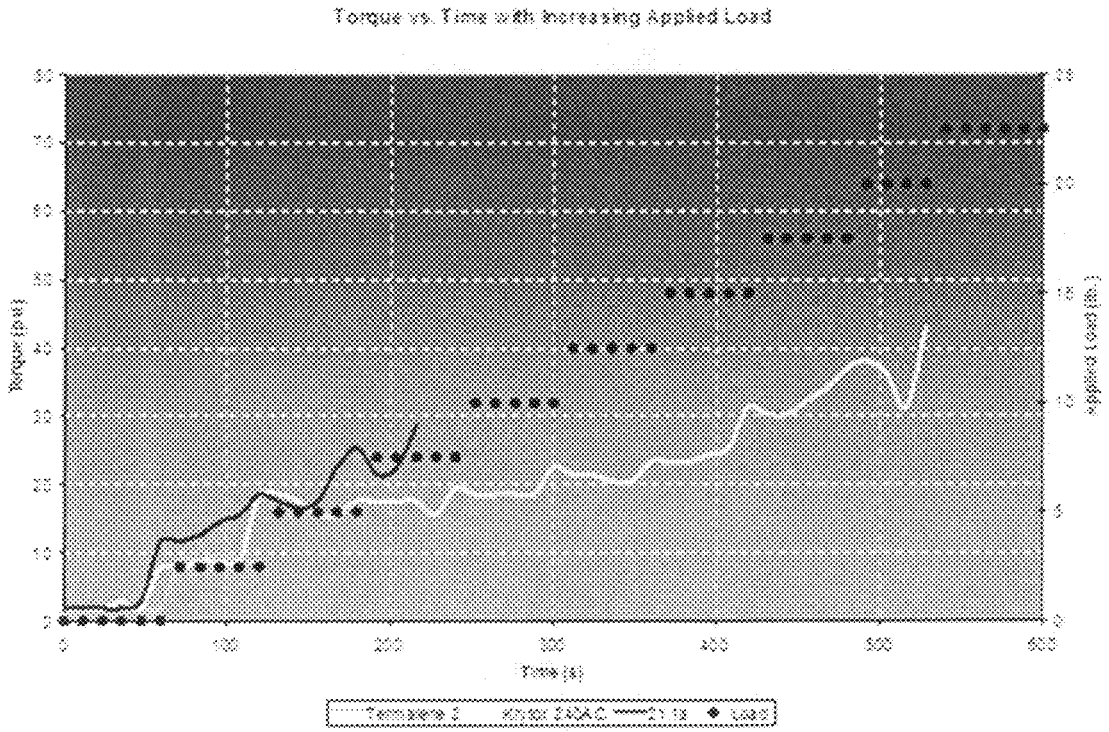
FIG. 10 shows additional data from in-house lubrication testing for initial screening formulations and available grease products.
Figure 11:
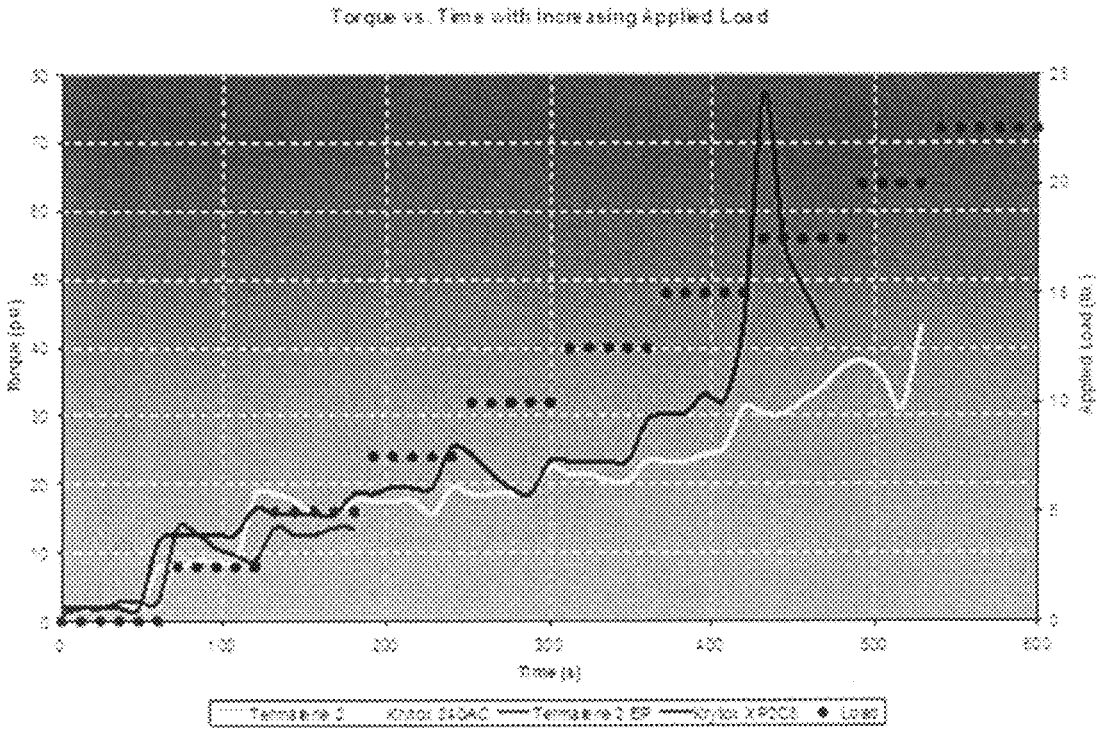
FIG. 11 shows additional data from in-house lubrication testing for initial screening formulations and available grease products.
Figure 12:
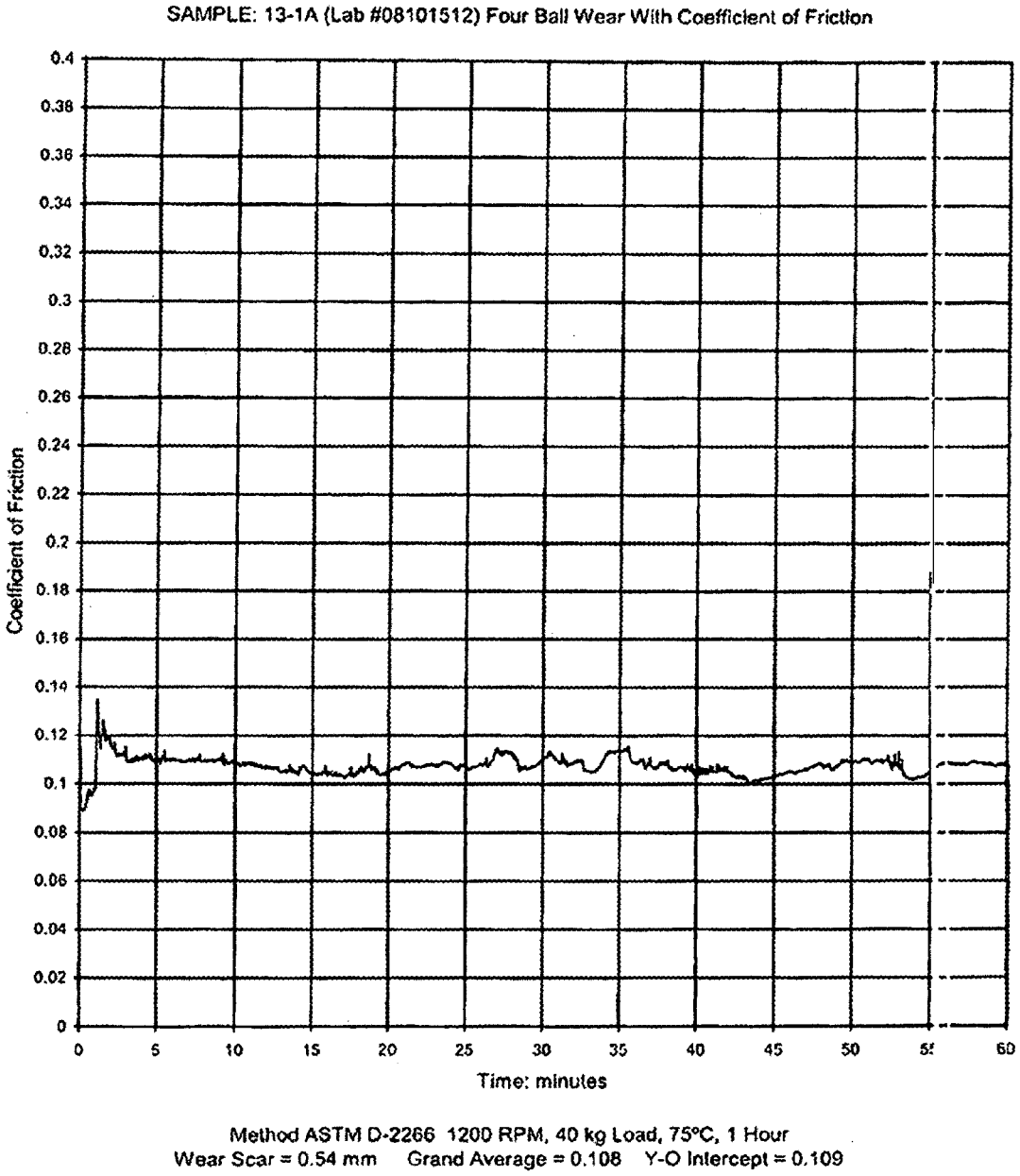
FIG. 12 shows a coefficient of friction graph generated from a 4-ball wear test for one of the initial screening formulations.
Figure 13:
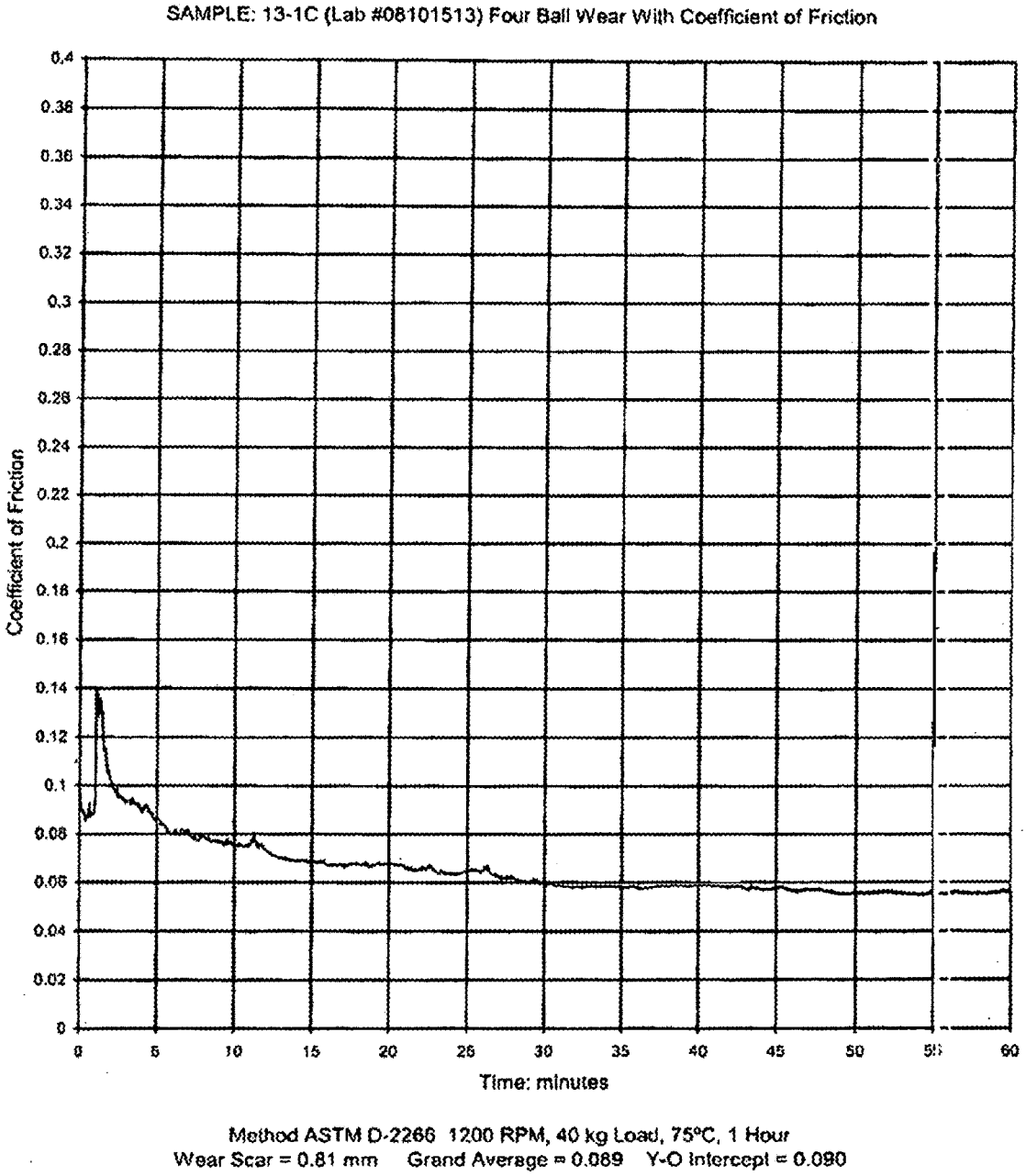
FIG. 13 shows a coefficient of friction graph generated from a 4-ball wear test for one of the initial screening formulations.
Figure 14:
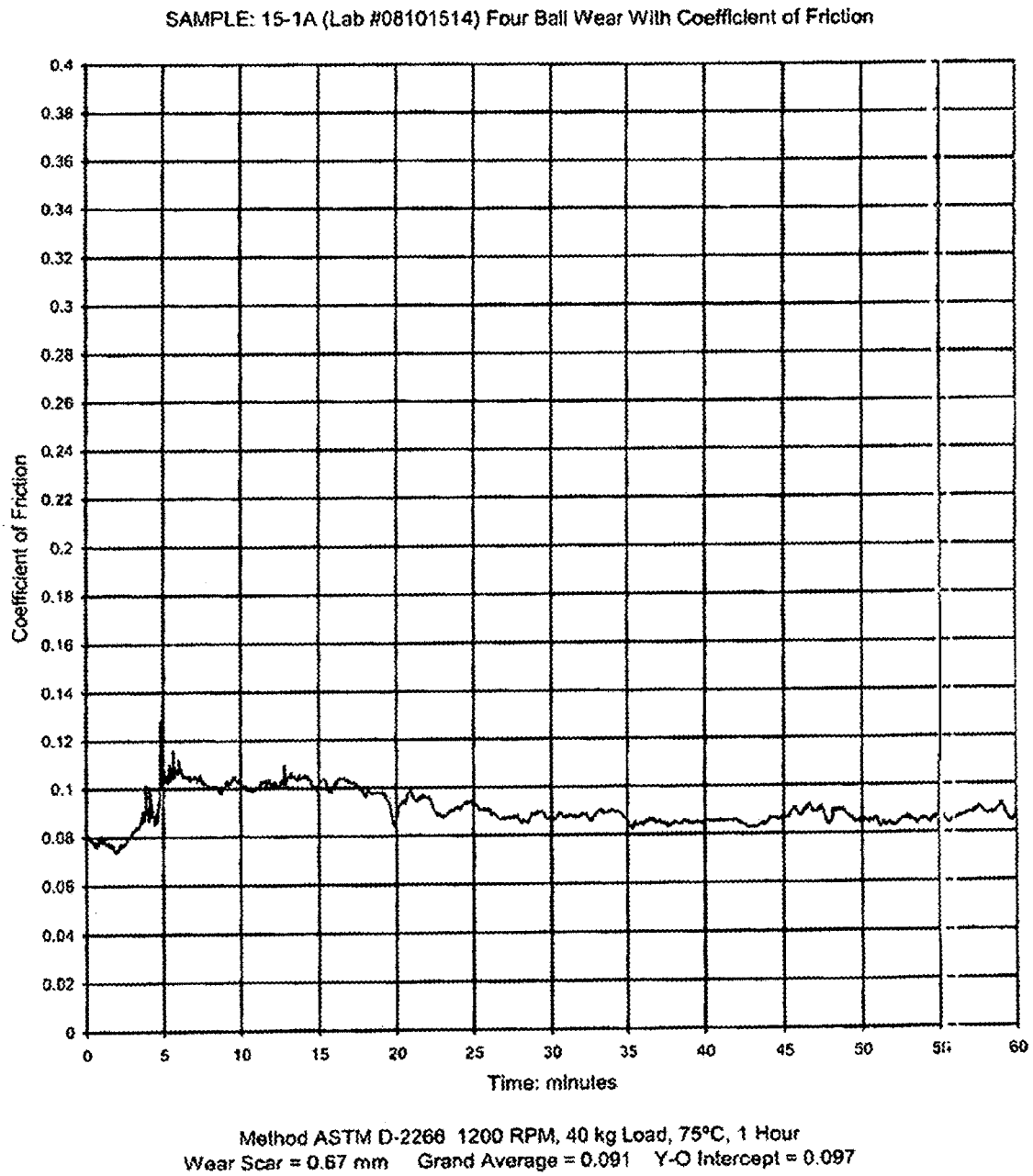
FIG. 14 shows a coefficient of friction graph generated from a 4-ball wear test for one of the initial screening formulations.
Figure 15:
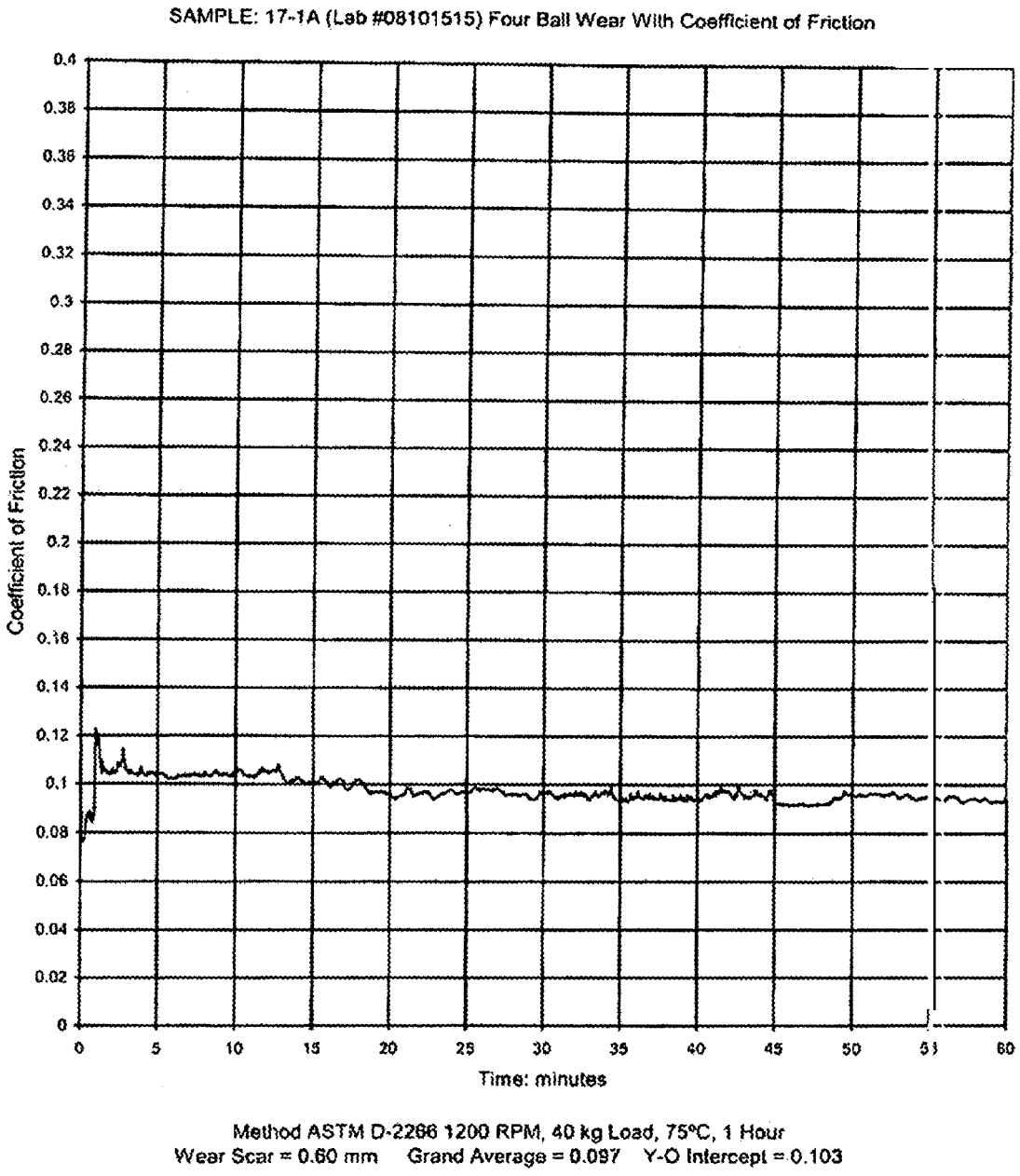
FIG. 15 shows a coefficient of friction graph generated from a 4-ball wear test for one of the initial screening formulations.
Figure 16:
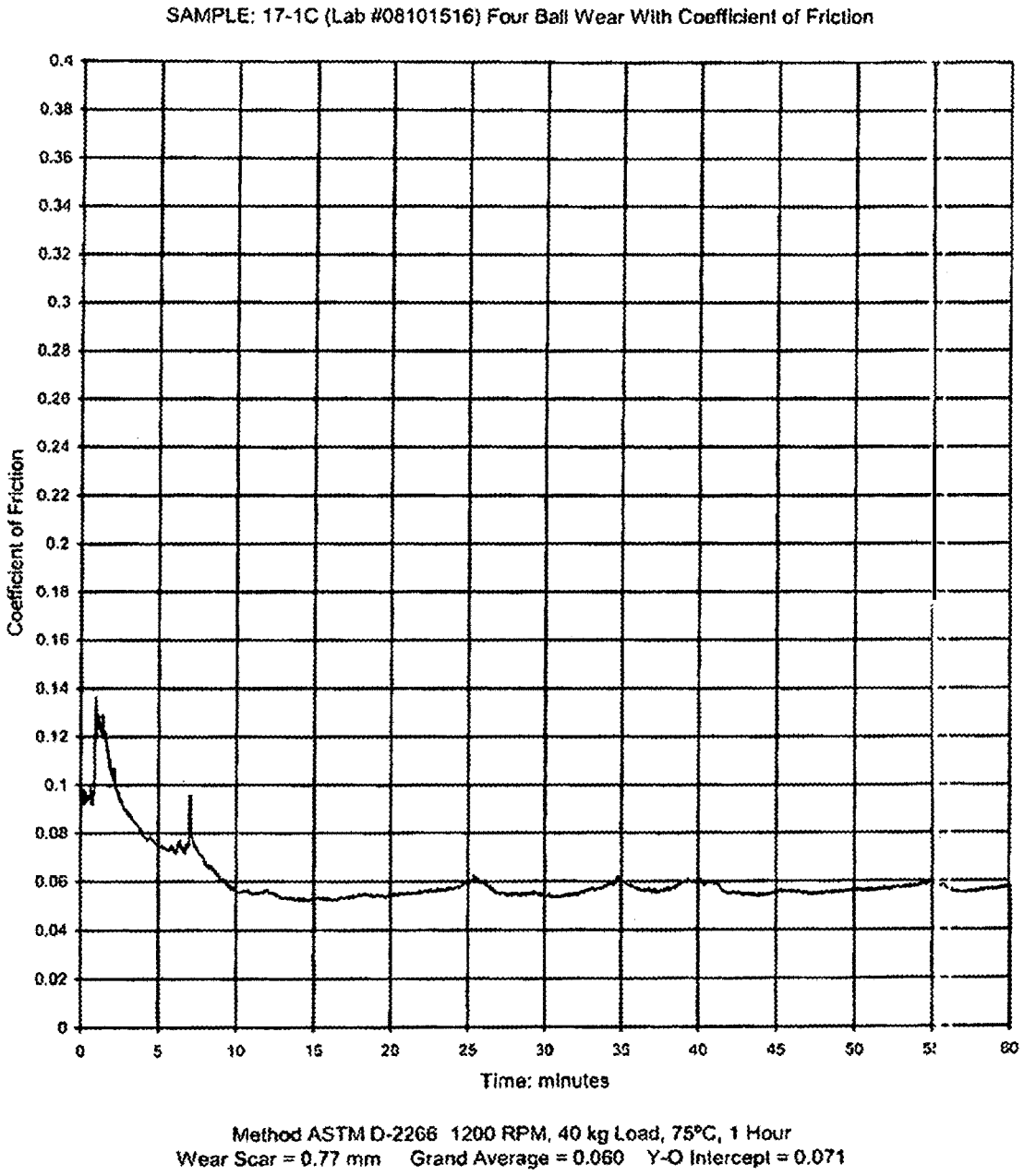
FIG. 16 shows a coefficient of friction graph generated from a 4-ball wear test for one of the initial screening formulations.
Figure 17:
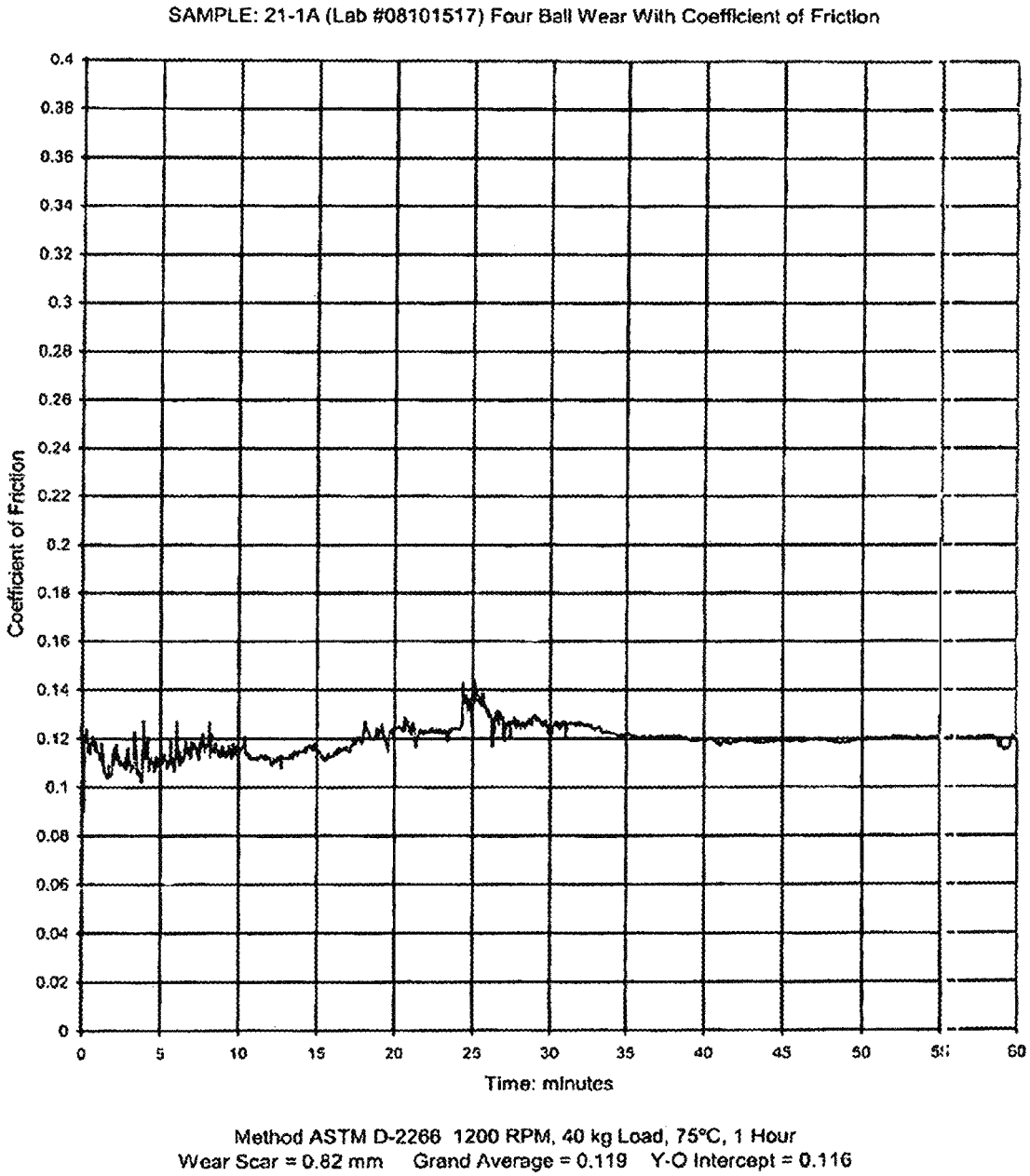
FIG. 17 shows a coefficient of friction graph generated from a 4-ball wear test for one of the initial screening formulations.

Initially, twenty candidate formulations were prepared and tested in-house. Table 2, below, gives the chemical composition of all formulations prepared and tested.

TABLE 2

| Formulation | Lubricating Oil | Filler | Percent Oil | Percent Filler | Molykote Z (20%) |
|---|---|---|---|---|---|
| FHG1-1A | Fluorolink D | Teflon (1 μm) | 62.1 | 37.9 | — |
| FHG3-13A | Fluorolink C | Teflon (1 μm) | 59.7 | 40.3 | — |
| FHG3-14A | Fluorolink E10 | Teflon (1 μm) | 53.8 | 46.2 | — |
| FHG11-1A | Fluro/Hydrocarbon Copolymer | Teflon (1 μm) | 52.6 | 47.4 | — |
| FHG11-2A | Fluro/Hydrocarbon Copolymer | Teflon (1 μm) | 52.3 | 47.7 | — |
| FHG11-3A | Fluro/Hydrocarbon Copolymer | Teflon (1 μm) | 52.4 | 47.6 | — |
| FHG11-4A | Fluro/Hydrocarbon Copolymer | Teflon (1 μm) | 52.3 | 47.7 | — |
| FHG13-1A | Alkyl Modified Fluorolink D | Teflon (1 μm) | 52.4 | 47.6 | — |
| FHG13-1B | Alkyl Modified Fluorolink D | Teflon (1 μm) | 52.4 | 47.6 | Added |
| FHG13-1C | Alkyl Modified Fluorolink D | Aerosil R202 | 94.3 | 5.7 | — |
| FHG13-1D | Alkyl Modified Fluorolink D | Aerosil R202 | 94.3 | 5.7 | Added |
| FHG15-1A | Alkyl Modified Fluorolink E10 | Teflon (1 μm) | 75 | 25 | — |
| FHG15-1B | Alkyl Modified Fluorolink E10 | Teflon (1 μm) | 75 | 25 | Added |
| FHG15-1C | Alkyl Modified Fluorolink E1043.8 | Aerosil R202 | 56.2 | 43.8 | — |
| FHG15-1D | Alkyl Modified Fluorolink E10 | Aerosil R202 | 56.2 | 43.8 | Added |
| FHG17-1A | Alkyl Modified Fluorolink D10H | Teflon (1 μm) | 59.2 | 40.8 | — |
| FHG17-1B | Alkyl Modified Fluorolink D10H | Teflon (1 μm) | 59.2 | 40.8 | Added |
| FHG17-1C | Alkyl Modified Fluorolink D10H | Aerosil R202 | 94.3 | 5.7 | — |
| FHG17-1D | Alkyl Modified Fluorolink D10H | Aerosil R202 | 94.3 | 5.7 | Added |
| FHG21-1A | Dioctylamine-terminated Krytox | Teflon (1 μm) | 53.7 | 46.3 | — |

Grease formulations were prepared by adding either polytetrafluoroethylene (PTFE) powder (1 micron particle size, commercially available from Aldrich Chemical Company) or hydrophobic fumed silica (Aerosil R202, commercially available from Evonik Degussa) to the candidate oil in an amount sufficient to obtain the desired viscosity. Some of the formulations were additionally mixed with 20% Molykote Z (a molybdenum disulfide powder available from Dow) to increase lubricity. The formulations were mixed thoroughly by hand and placed in a 100° C. oven for one hour to expedite the wetting-out of the particles. The resultant greases were then filtered through a fine wire mesh in order to remove any particles that have not been wet out.

Formulation FHG 15-1 (based on the poly(ethylene glycol) terminated PFPE) was thick enough to resist any flow at room temperature. However, (as discussed below) the oil performed relatively well in in-house lubrication screening tests.

A preferred embodiment of the grease formulation comprises a hydrofluorocarbon base oil made up by reacting a perfluoropolyether (such as Fluorolink™ E10H supplied by Solvay Solexis) with n-butyl isocyanate in a ratio of 9:1 by weight. To facilitate the reaction, a dibutyltindilaurate catalyst is added at a rate of 1.5% by weight of isocyanate. The reaction is stirred overnight in a large Erlenmeyer flask at 70° C. until the isocyanate is no longer present as determined by reaction with an amine and back titration of the unreacted amine. A thixotropic fumed silica filler (such as Aerosil R202) may be blended into the base oil in an amount not to exceed 8% of the total grease formulation. An extreme pressure filler, such as boron nitride (grade AC6041 from Momentive) may be blended into the base oil in an amount not to exceed 0.5% of the total grease formulation. A liquid, ashless antioxidant (such as Vanlube 961), may be blended into the base oil in an amount not to exceed 0.5% of the total grease formulation. A liquid, ashless antioxidant and extreme pressure additive (such as Vanlube 7723), may be blended into the base oil in an amount not to exceed 0.5% of the total grease formulation. An anti-wear additive and rust inhibitor (such as Vanlube 9123, an amine —phosphate compound), may be blended into the base oil in an amount not to exceed 0.5% of the total grease formulation.

In the preferred embodiment, the components include about 80-95% perfluoroalkylether lubricating oil, about 5-10% fumed silica, about 0.1-1% boron nitride, about 0.1-1% antioxidant and extreme pressure additive, about 0.1-1% antioxidant, and about 0.1-1% anti-wear additive and rust inhibitor.

Example 1

In-House Lubrication Testing

In Falex Pin and Vee-Block testing, a rotating pin is lubricated and pressed between two V-shaped aluminum blocks. This is a load to failure test that uses progressive loading on the V-shaped blocks that squeeze the pin. The test terminates when the shaft seizes or the machine reaches its top loading rate of 3000 psi. The relatively slow sliding speed (290 rpm) makes this test appropriate for the evaluation of greases and solid lubricants.

In the tests performed to date, there have been no observations of any seizure of the rotating shaft. Instead, a "smoke-point" was observed and noted for each candidate formulation. Taking this smoke-point to be the failure point, it is possible to rank the various candidate formulations. The results of these tests are presented graphically in FIGS. 5 through 11. In each case, screening formulations were compared with the Dupont Krytox® 240AC and Bel-Ray Termalene® 2 products. Each graph shows the results from a different grease series. The torque was measured as the load was increased at one minute intervals. Failure is indicated by the end-point of each line. Good performance is indicated by a long, flat response to increasing load while short responses indicate early failure. The new grease formulations performed better than the Termalene® 2 in all cases, and a number of the candidate grease formulations performed equal to or better than Krytox® 240AC. It is anticipated that the new compositions will be significantly less expensive than the Krytox® greases.

From the in-house lubrication analysis, it was determined that all of the formulations prepared provide excellent lubrication. Based on the Falex testing results, the results from off-gas analysis (discussed below), material availability, and cost, six formulations were also sent to an outside facility for further analysis. Termalene® 2, Krytox® 240AC, and Krytox® XP2C5 were also sent for comparison. To complete both the 4-ball wear (ASTM D-2266) and water washout test with synthetic seawater (ASTM D-1264), it was necessary to prepare 100 g of each material. The large-scale preparation of each grease was carried out as discussed previously.

Example 2

Four Ball Wear Testing (ASTM D-2266)

The Four Ball Wear test (ASTM D-2266) was performed by Petro-Lubricant Testing Laboratories (Lafayette, N.J.). In this test, three steel balls (0.5" diameter) were clamped together and lubricated with the sample grease. A fourth ball of equal size was pressed into the cavity in the center of the clamped balls. The top ball was pressed into the cavity with a force of 40 $kg_f$. The temperature was then regulated at 75° C. for 60 minutes while the top ball was rotated at 1200 rpm. Lubricants were then ranked based on the average length of the resultant wear scars on the three clamped steel balls. Typically, the governmental standard for adequate lubrication is a wear scar of 1.00 mm or less. The results of this test for all formulations submitted are given below in Table 3. As shown, all of the new grease formulations perform very well. Good lubrication is indicated by a short wear scar length (acceptable limit of 1.00 mm or less) and low coefficient of friction. Krytox® 240AC performs very poorly in this test, and will be discussed further below. Petro-Lubricant Testing Laboratories also has the ability to chart the coefficient of friction in real time during the test. These charts are shown in FIGS. 13-21.

TABLE 3

| Grease Sample | Wear Scar Length (mm) | Coefficient of Friction |
|---|---|---|
| FHG 13-1A | 0.54 | 0.108 |
| FHG 13-1C | 0.81 | 0.089 |
| FHG 15-1A | 0.67 | 0.091 |
| FHG 17-1A | 0.60 | 0.097 |
| FHG17-1C | 0.77 | 0.060 |
| FHG 21-1A | 0.82 | 0.119 |
| Termalene 2 | 0.86 | 0.131 |
| Krytox 240AC | 1.99 | 0.157 |
| Krytox XP2CS | 0.72 | 0.128 |

Figure 18:
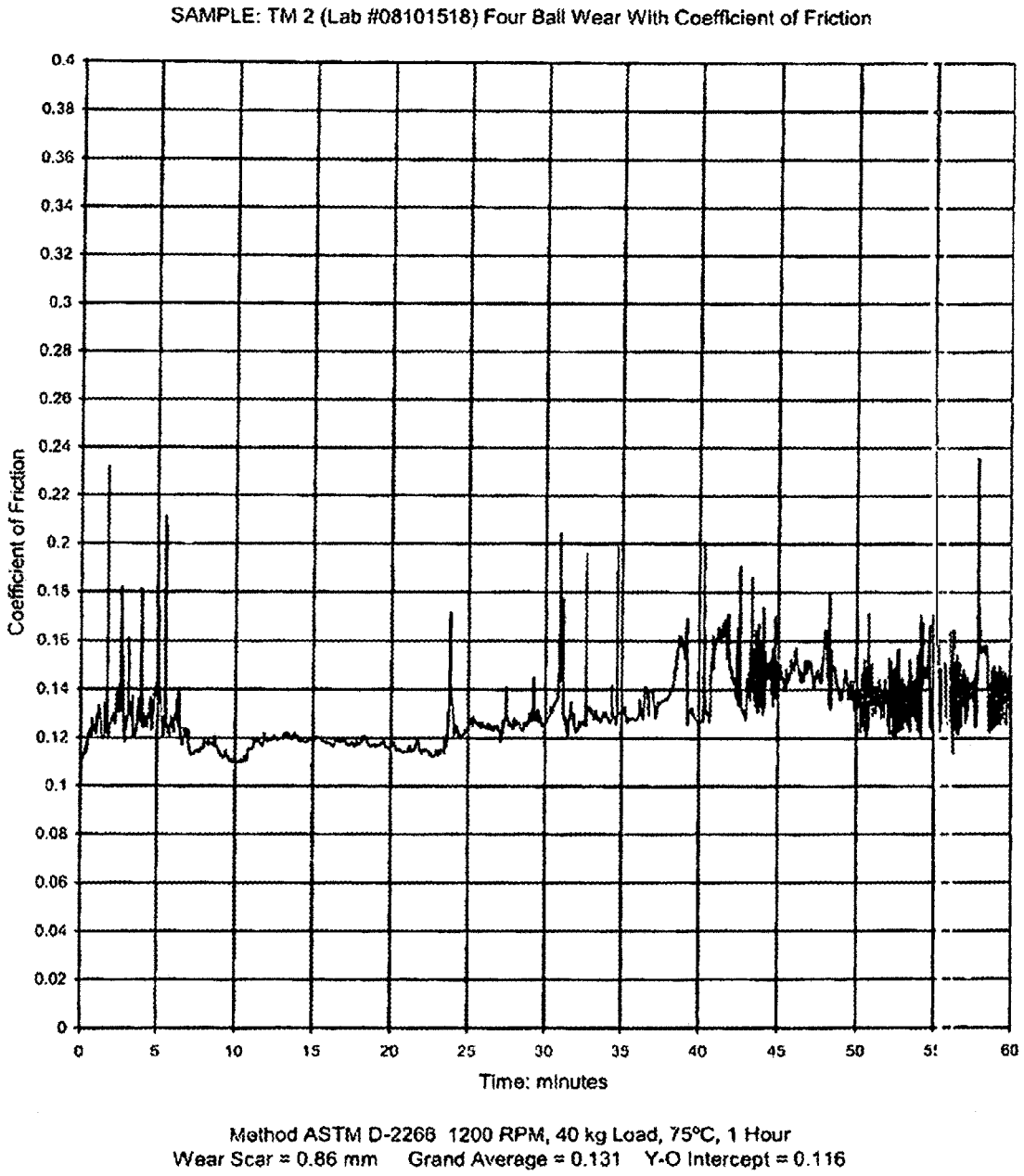
FIG. 18 shows a coefficient of friction graph generated from a 4-ball wear test for one of the available greases.

FIGS. 12-17 show the results for the new grease formulations, all of which performed very well. Their excellent performance is indicated by the low value and relatively smooth line for the entire duration of the test. FIG. 18 shows the results for Termalene® 2. The coefficient of friction (0.131) is higher than all of the new grease formulations. Additionally, the wear scar length (0.86 mm) is longer, indicating worse performance. Although the average coefficient of friction is relatively low for this grease, the spikes in the graph indicate that a small amount of micro-welding is occurring due to the grease not forming an adequate lubrication film on the steel balls.

Figure 19:
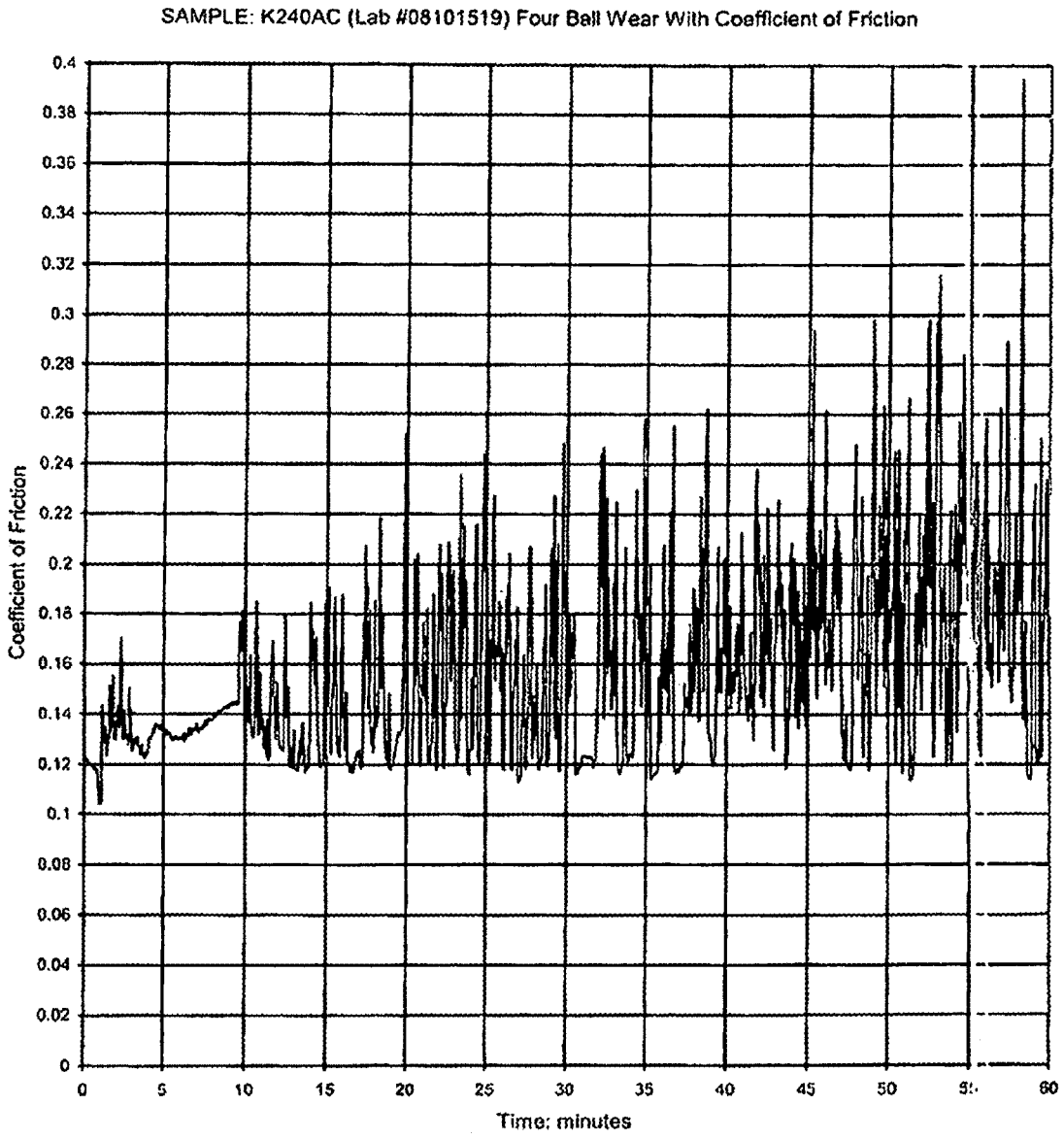
FIG. 19 shows a coefficient of friction graph generated from a 4-ball wear test for one of the available greases.
Figure 20:
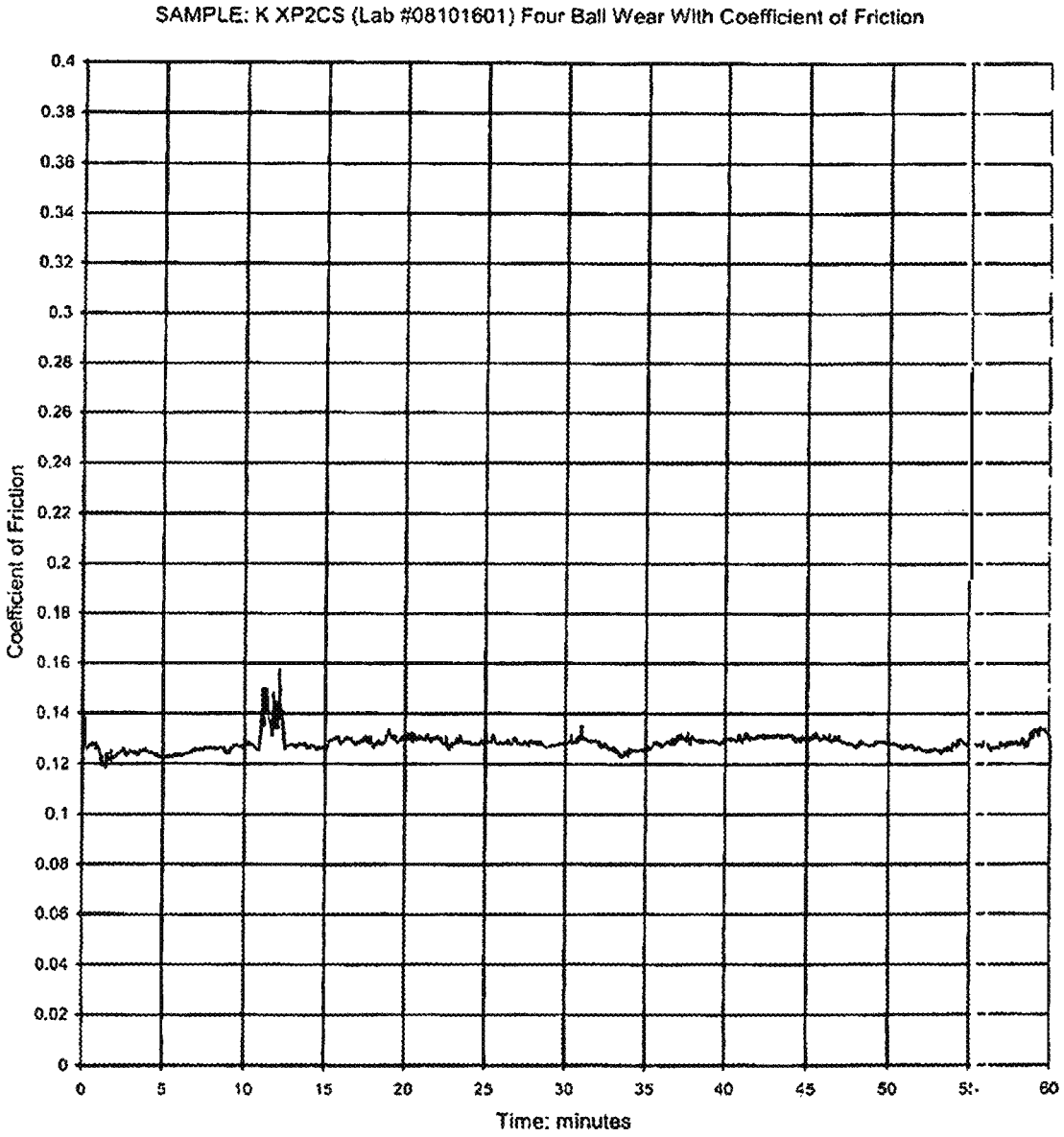
FIG. 20 shows a coefficient of friction graph generated from a 4-ball wear test for one of the available greases.

FIG. 19 shows the results for the Krytox® 220AC grease. The coefficient of friction (0.157) is higher than all of the new grease formulations and the Termalene® 2. Additionally, the wear scar length (1.99 mm) is nearly twice the acceptable limit of 1.00 mm. These results indicate that the Krytox® grease is not able to form an adequate thin film on the surface of the bearing. The extreme number of spikes in this graph indicate that a large amount of micro-welding is occurring due to the complete inability of this material to form an adequate thin film on the steel balls. Straight PFPEs such as the Krytox®-based greases typically exhibit this problem. Although the new grease formulations are also based on PFPEs, the hydrocarbon functionality in the ABA copolymer (discussed above) is apparently enough to drastically increase the affinity for steel, leading to better film formation and ultimately better performance. Additionally, it is believed that this low affinity for steel of PFPE based greases such as Krytox may contribute to the poor resistance to seawater washout. FIG. 20 shows the results for the Krytox® XP2C5 grease. The coefficient of friction (0.128) is higher than all of the new grease formulations. The wear scar length of 0.72 mm is acceptable. The overall performance of this grease is better than that of Krytox® 240AC due to the addition of some compatibilizing additives, but not as good as any of the new grease formulations tested.

Example 3

Water Washout (ASTM D-1264) with Synthetic Seawater and In-House

The Water Washout (ASTM D-1264) test was also performed by Petro-Lubricant Testing Laboratories. For the purposes of this project, synthetic seawater was used, as opposed to the distilled water called for in the test method. In this test, the candidate grease was packed into a ball bearing, which was then placed in a housing with specified clearances and rotated at 600 rpm. Synthetic seawater (100° F.) was then impinged on the bearing housing at a rate of 5 ml/s. The test was run for 1 hour, after which time the bearing was dried at 170° F. for 15 hours. The dried bearing was weighed and the difference in pre-test and post-test weight was taken as the amount of grease washed out. The water washout results on the samples tested are given below in Table 4.

TABLE 4

| Grease | Water Washout |
|---|---|
| FHG 13-1A | 0.00% |
| FHG 13-1C | 0.22% |
| FHG 15-1A | 0.50% |
| FHG 17-1A | 1.04% |
| FHG 17-1C | 1.70% |
| FHG 21-1A | 1.53% |
| Termalene 2* | 0.00% |
| Krytox 240AC | 0.00% |
| Krytox XP2C5 | 0.00% |

These results show that the new grease formulations have excellent resistance to water washout under these conditions. Specifically, FHG 13-1A shows absolutely no material loss after this test. However, both Krytox® products also show zero washout in this test. Since it has been determined that Krytox® 240AC is susceptible to washout, it became apparent that this test method does not adequately represent the application on which the grease is currently being used.

Since the ASTM standard method of resistance to water washout was ultimately inconclusive, a test was devised in-house. Stainless steel panels were solvent-cleaned and weighed before a thin layer of grease was applied to the surface. The panels were then re-weighed and submerged in synthetic seawater overnight at room temperature. After 15 hours, the panels were removed from the seawater bath and dried in a 70° C. oven for one hour. The final weight was recorded and used to calculate the percent washout. The results are given below in Table 5.

TABLE 5

| Grease | Percent Washout |
|---|---|
| Krytox 240AC | 0.11% |
| Krytox XP2C5 | 0.41% |
| FHG 1-1A | 0.00% |
| FHG 13-1A | N/A |
| FHG 15-1A | 0.00% |
| FHG 17-1A | 0.00% |
| FHG 21-1A | 0.24% |

These results show that both of the Krytox® greases supplied by DuPont do show slight washout under these conditions. Although the numbers are relatively low, over a longer length of time, the results are expected to be more severe. Three of the new grease formulations tested did not show any water washout under these conditions. This test demonstrates the ability of the newly developed greases to resist water washout.

Example 4

Off-Gas Testing

In the submarine hangar areas and dry deck shelters where these greases are intended for use, pressures of up to 6 atm may be reached. Elevated temperatures (up to 150° F.) are also possible. It is imperative that the greases utilized do not off-gas any material under these conditions, as divers may be present. In order to test for potential off-gassing from candidate greases under these conditions, a gas chromatography/mass spectrometry (GC/MS) method was developed. A stainless steel pressure tube with a pressure gauge and valve to allow for charging and discharging purified air (zero air) up to 89 psi was utilized to subject candidate grease formulations to 89 psi of pure (zero) air at 150° F. for 24 hours. These conditions were chosen to adequately mimic the environment in which the grease will be used. Candidate formulations were placed inside the tube, charged with the requisite pressure, and heated for 24 hours before analysis of the head-space by GC/MS for any volatile components. Tedlar gas sampling bags (commercially available from SKC) were utilized to collect the exhaust from the pressure tube, and Solid Phase Micro Extraction (SPME) fibers (commercially available from Supelco) were utilized to collect volatiles from the sampling bag.

After 24 hours at 150° F. and 89 psi, the exhaust from the pressure tube was purged directly into a new sampling bag. For quantitative estimation, 100 nanograms of 4-bromofluorobenzene was injected into each bag as an internal standard. A preconditioned SPME fiber was then inserted through the septum end of the Tedlar bag sampling valve, and allowed to absorb organic products for 1 hour. Previous experiments have indicated that 1 hour is sufficient to capture nearly all of the organic material present in the sampling bags. The SMPE fibers utilized consist of a pre-conditioned fiber coated with Carboxen/PDMS (polydimethylsiloxane) sorbents, which have a very high affinity for volatile and semi-volatile organics. After sample collection, the SPME fiber was placed directly inside an OPTIC 2 Inlet and analyzed by GC/MS.

Figure 22:
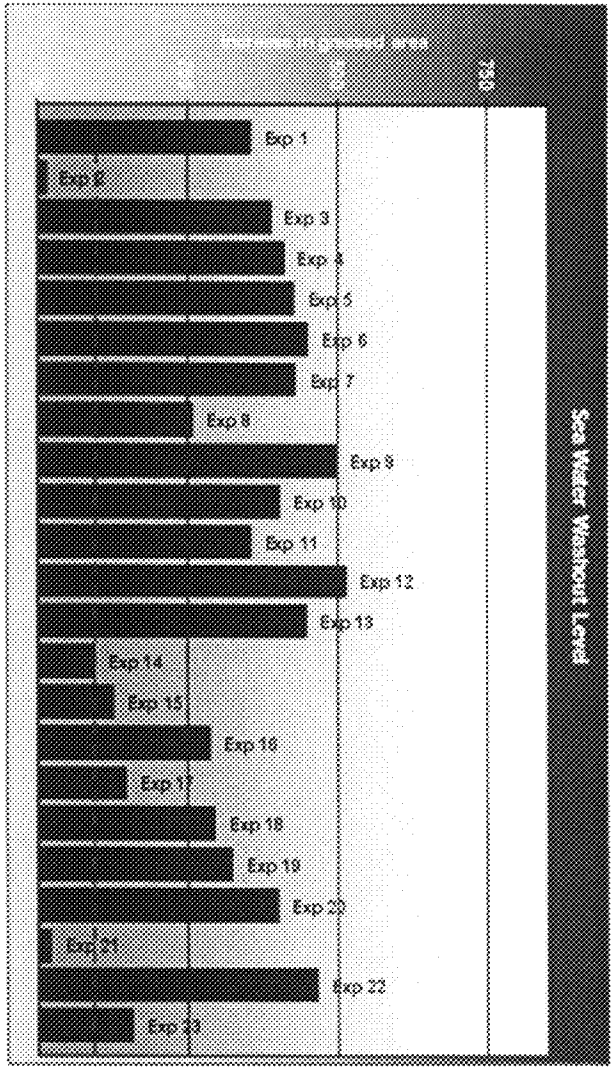
FIG. 22 shows water washout data from 23 grease formulations.

GC/MS is an extremely sensitive technique that allows for the detection of trace amounts of material. As such, background noise and trace contamination can be hard to reduce when very low levels of material are being assessed. Thus it is most relevant to compare the total hydrocarbon content collected from the new developed grease formulations with that of Termalene® 2 and Krytox® 240AC. The relative levels of total hydrocarbon content in each sample are shown in FIG. 22. Since the solid particulate filler has no effect on the results, only one representative grease based on each lubricating oil was analyzed.

Figure 21:
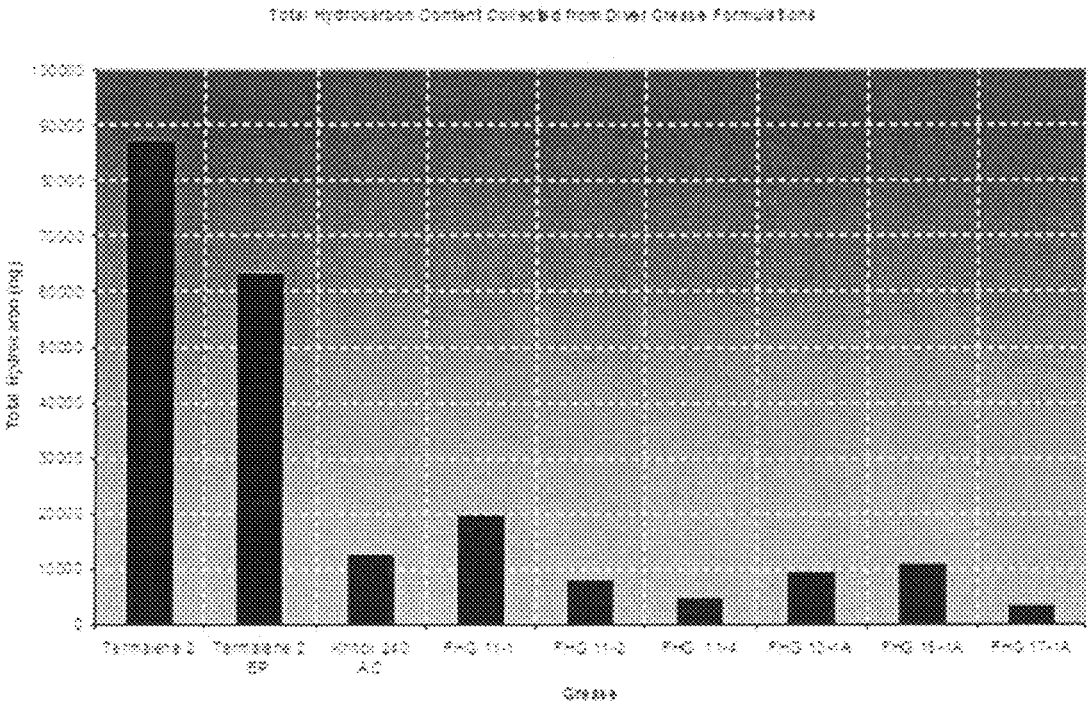
FIG. 21 shows total hydrocarbon content collected from each grease sample.

As shown in FIG. 21, Termalene® 2 and Termalene® 2 EP release significant amounts of organic material under these conditions. All of the newly developed products (with the exception of FHG 11-1) release levels of organic materials that are equal to or less than Krytox® 240AC, which was previously found to be acceptable. The higher level of material released from FHG 11-1 was likely due to incomplete purification of the lubricating oil after synthesis. Nevertheless, all of the newly developed grease formulations should be acceptable for use in closed environments.

Example 5

Cost/Benefit Analysis

Material cost data for Krytox® 240AC was obtained and compared to the estimated production cost for two of the new grease formulations (FHG13-1A and FHG13-1C). A licensed Krytox® distributor was contacted for pricing information. Assuming the bulk rate (purchases of 20 kg or more), Krytox® 240AC currently costs $784/lb. It is assumed for this demonstration that 100 lbs. would be used each year for a military application (due to the frequent replacement necessary). Material costs were calculated for FHG 13-1A and FHG 13-1C. These costs may be somewhat over-estimated as bulk pricing was not readily available for all materials. Total material costs were scaled by a factor of 1.3 to account for packaging and manufacture. Based on this analysis, FHG 13-1A would cost $367/lb and FHG 13-1C would cost $157/lb. These prices represent the delivered product. Assuming that the newly developed greases last twice as long as Krytox® 240AC, only 50 lbs. would be used each year. Based on this assumption, the cumulative expenditures were calculated for the grease of choice over a ten year period. Material costs alone account for a savings of more than $650,000 over ten years. This does not account for the additional cost savings resulting from decreased maintenance time.

Example 6

Experimental Screening of Selected Formulations

In more advanced analysis, a systematic experimental design study of the formulation components was used to facilitate grease formulation development. This practice is essential to producing an optimized, cost-effective diver safe grease with excellent resistance to seawater washout and zero off-gassing. Experimental design allows for evaluation of a wide range of variables at a minimum cost. In grease mixture experiments, the design factors are the components of the mixture; response is a function of the proportions; and the ingredients must total 100%. Special polynomials were used to calculate the results of a mixture design. This design approach saves time, effort, and material. Experimental design software from Stat-Ease, Inc. was used on a routine basis for formulation and process optimization. Experimental design is an iterative process—the output from one optimization can easily be used as a starting point for a second design matrix. This allows for the inclusion of components that may not have been present in the original formulation to be incorporated.

The steps in an experimental design process are:

1. Identify the independent variables (factors). These include binder composition (lubricating oil(s)), additive types and concentrations, etc. The key to a successful experimental design program is identification of all factors (components) that significantly affect the outcome of the process. To minimize cost, it may be just as important to eliminate insignificant components or factors as to include significant ones.

2. Identify the dependent variables (responses). These will include lubrication performance (as tested by falex pin and vee block), resistance to seawater washout (as tested by a NAVSEA preferred method), off-gassing (as tested by the method developed by TRI/Austin in Phase I), as well as smell, abbreviated salt fog, and elastomer compatibility. Other responses can be added as needed. The analysis software provides for the use of a mathematical weighting function to assign the relative importance of each dependent variable in optimizing the new diver safe grease formulations.

3. Select the factor ranges. Exploratory experiments are required to set the minimum and maximum values of each continuous independent variable. In a second iteration of formulation work selected important factor ranges will be narrowed to tighten formulation tolerances.

4. Select the type of design. The possibilities include simplex lattice, simplex centroid, D-optimal, and distance-based designs. The choice is made based on the expected response surface, which will be estimated from exploratory experiments.

5. Set up the design. The result of this step is a table listing the parameters to be used in each experiment.

6. Run the experiments. For this project, a considerable number of grease formulations will be produced and tested in order to cover the entire parameter space of reasonable formulations. The initial exploratory work could require as many as 30 formulations.

7. Analyze the responses. Standard software (Design Expert) will be used to determine the shape of the response hypersurface. The responses and desirability index will then be used to produce an optimized formulation.

Optimization test matrix #1 consisted of 23 formulations of the novel lubricating oils combined with varied amounts of fillers to create grease formulations that not only resist washout, but do not off-gas and protects against corrosion/oxidation. Table 6 below shows the various formulations to be tested. Because the antioxidants and rust inhibitor make up such a small percentage of the formulation these were added to all formulations. They can be left out to determine their effectiveness in an optimized grease formulation. In this first design the component ingredients include the novel lubricating oil (Butyl), a thixotropic filler (silica), a high temperature high lubricating filler (PTFE), corrosion inhibitor (sebacate), EP additive (Hex BN), and an antioxidant/rust inhibition package (Vanlube).

TABLE 6

| Run | Butyl | Silica | PTFE | Sebacate | Hex BN | Vanlube |
|---|---|---|---|---|---|---|
| 1 | 90.0% | 3.0% | 2.3% | 3.3% | 0.0% | 1.5% |
| 2 | 90.0% | 8.0% | 0.5% | 0.0% | 0.0% | 1.5% |
| 3 | 90.5% | 3.0% | 0.0% | 5.0% | 0.0% | 1.5% |
| 4 | 92.0% | 3.0% | 0.0% | 2.0% | 1.5% | 1.5% |
| 5 | 90.0% | 3.0% | 4.0% | 0.0% | 1.5% | 1.5% |
| 6 | 90.4% | 3.7% | 1.2% | 1.3% | 2.0% | 1.5% |
| 7 | 92.0% | 3.5% | 0.0% | 0.0% | 3.0% | 1.5% |
| 8 | 90.8% | 4.9% | 1.6% | 0.0% | 1.2% | 1.5% |
| 9 | 92.0% | 3.0% | 1.8% | 1.8% | 0.0% | 1.5% |
| 10 | 92.0% | 3.0% | 1.8% | 1.8% | 0.0% | 1.5% |
| 11 | 92.0% | 3.0% | 3.5% | 0.0% | 0.0% | 1.5% |
| 12 | 90.0% | 3.0% | 2.5% | 0.0% | 3.0% | 1.5% |
| 13 | 90.0% | 3.0% | 0.0% | 2.5% | 3.0% | 1.5% |
| 14 | 92.0% | 6.5% | 0.0% | 0.0% | 0.0% | 1.5% |
| 15 | 90.0% | 5.5% | 0.0% | 0.0% | 3.0% | 1.5% |
| 16 | 92.0% | 4.8% | 0.0% | 1.8% | 0.0% | 1.5% |
| 17 | 90.0% | 5.5% | 0.0% | 0.0% | 3.0% | 1.5% |
| 18 | 90.0% | 4.5% | 4.0% | 0.0% | 0.0% | 1.5% |
| 19 | 90.0% | 4.5% | 4.0% | 0.0% | 0.0% | 1.5% |
| 20 | 92.0% | 3.0% | 2.0% | 0.0% | 0.0% | 1.5% |
| 21 | 90.0% | 8.0% | 0.5% | 0.0% | 0.0% | 1.5% |
| 22 | 90.8% | 3.0% | 4.0% | 0.8% | 0.0% | 1.5% |
| 23 | 90.0% | 5.8% | 0.0% | 2.8% | 0.0% | 1.5% |

Example 7

Further Water Washout Testing

Due to inconsistent results and poor correlation with empirical field washout results from the ASTM distilled water washout test as conducted by Petro-Lubricant Testing Laboratories, Inc., a seawater washout test had to be devised to compare formulations. Each of the 23 formulations underwent this test to determine the effects of each ingredient on water washout.

The seawater washout test method is as follows: 1. Fill the water storage tank with 10 gallons of seawater. 2. Attach the grease test template to the 6"×6" test plate. A circle inscribed inside the test template gives a visual queue as to how much washout has occurred without computer assisted surface area calculations. 3. Test grease is applied to the template and a metal straight edge is pulled across to form a uniform grease circle on the test plate. The template is filled with grease at this point followed by removal of the template and subsequent testing. 4. The test plate is attached to the testing mount and positioned inside the water storage tank so that the test grease circle is 10.5 cm away from the water pump output. The specimen mount should be level to allow for uniform grease washout. 5. The test commences by turning on the water pump, and pumping 1.5 gallons of seawater per second over the test plate in an effort to washout out the grease. 6. Once testing has finished, analysis begins. The test sample is scanned on a computer scanner and opened inside a program called Digimizer which is capable of determining the exact surface area of a shape.

Formulations from the experimental grease formulations were run under this seawater washout test procedure for five seconds and were compared for their resistance to water washout. The formulations ranged in washout properties from barely any grease outside the circle to a grease coating that almost covers the entire panel. FIG. 22 shows the water washout data for all 23 formulations. The dashed red line denotes the water washout level for Termalene®. Some formulations did indeed mimic Termalene® while some did much better.

Example 8

Further Lubrication Testing

Figure 23:
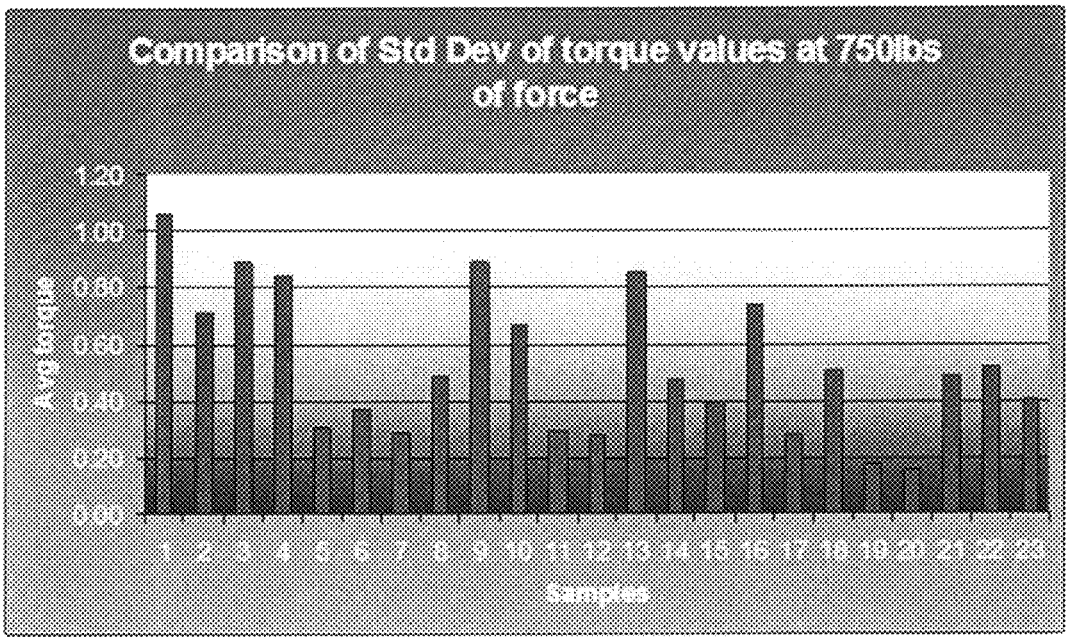
FIG. 23 shows lubrication data from 23 grease formulations.

Additional lubrication testing of the 23 sample formulations was performed according to the method described in Example 1. Results are found in FIG. 23, which shows the Falex Pin and Vee Block deviation data for all 23 formulations. In this test, a low value is desirable as it shows that at high load force, the grease maintains its lubricity even until failure. When analyzed, it will be determined if a combination of fillers is responsible for this attribute.

Example 9

Salt Fog Testing

Figure 24:
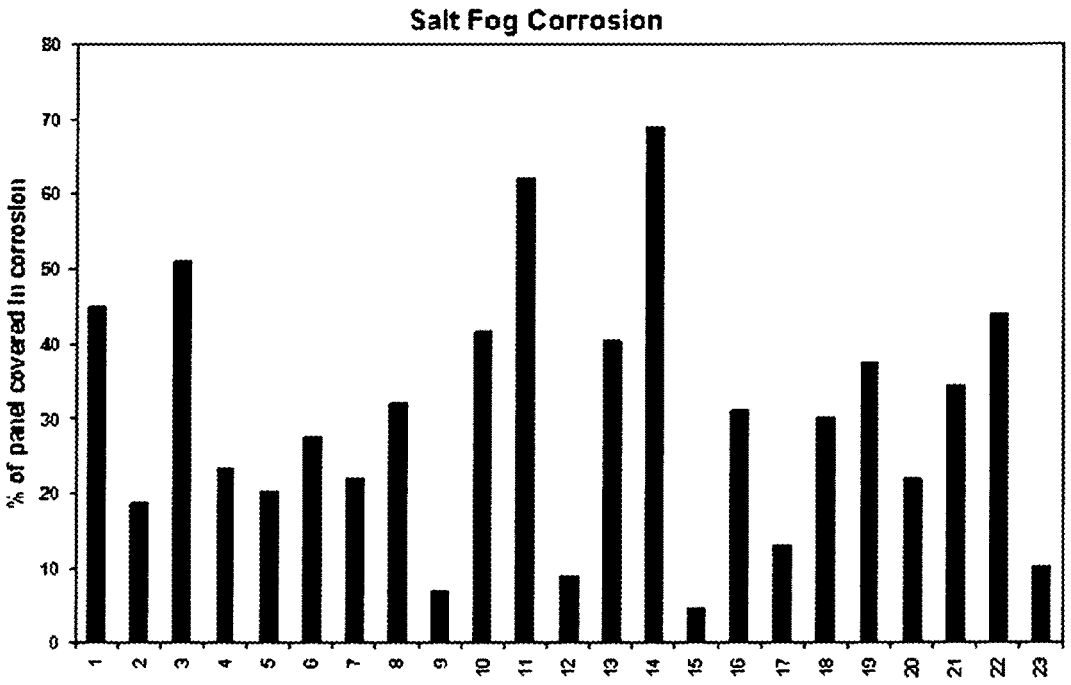
FIG. 24 shows salt fog corrosion data from 23 grease formulations.

ASTM B117 amended for grease applications was used to determine the salt spray corrosion properties of the various grease formulations. Each test panel was prepared by cleaning the panel followed by a solvent wipe with hexane to remove any foreign materials from the surface. The grease was then smeared across one whole side of the panel to ensure minimum pin-holing and to ensure uniform coverage. The panels were observed at 48 hours and again at 168 hours (one week). This amount of time under the harsh environment of the salt fog cabinet gave an idea of the corrosion barrier properties of the various greases. The same regular alloy steel from the water washout tests was used for salt fog determination. This is a very vigorous corrosive environment, but shows dramatic differences in corrosion control properties of the greases. FIG. 24 shows the salt fog corrosion data. Each bar represents one of the 23 formulations, while the size of the bar is a representation of the amount of corrosion allowed during the test procedure.

Example 10

Salt Water Immersion Testing

Figure 25:
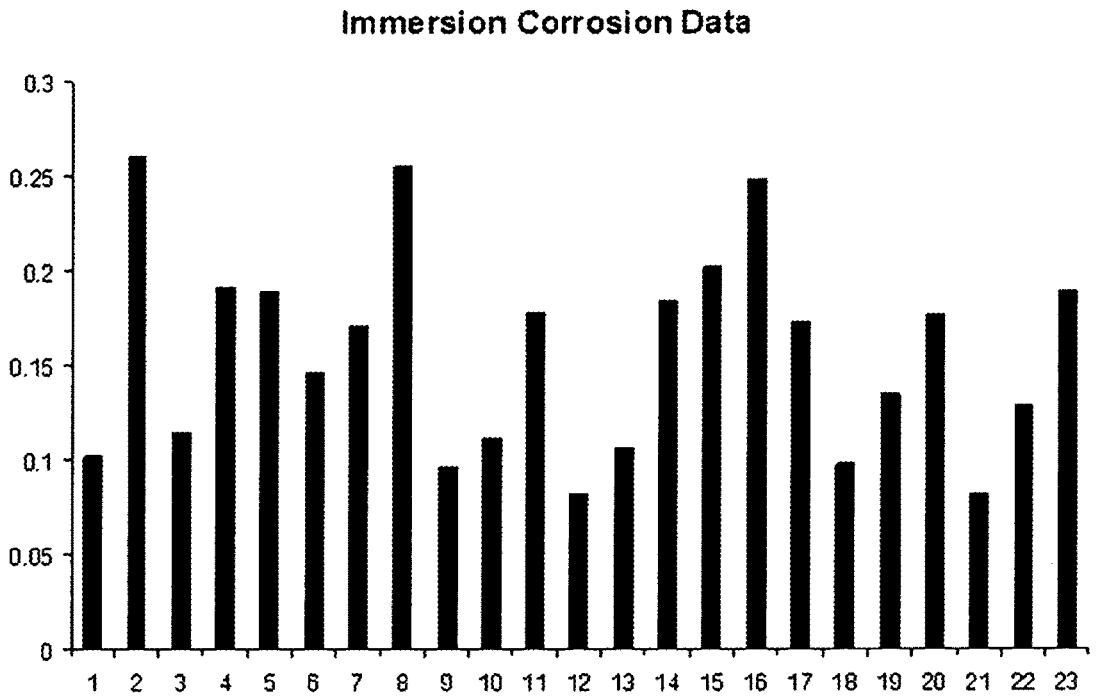
FIG. 25 shows salt water immersion corrosion data from 23 grease formulations.

ASTM D870 was used as a guide to create an addendum to the water washout testing. Panels of Krytox®, Termalene®, and the final new grease formulation underwent continuous lifetime testing in sea water as suggested. This included immersing the water washout panels in sea water. Changes in the panel and grease were noted daily for five days followed by weekly for a longer period of time until a clear trend could be noted. This test looked at water washout during sea water exposure due to dissolving, ability of the grease to prevent corrosion of the steel panel, and adhesion of the grease to the steel panel when surrounded by corrosion. FIG. 25 shows the salt water immersion corrosion data. Each bar represents one of the 23 formulations, while the size of the bar is a representation of the amount of corrosion allowed during the test procedure.

Example 11

Fourier Transform Infrared Testing

Figure 26:
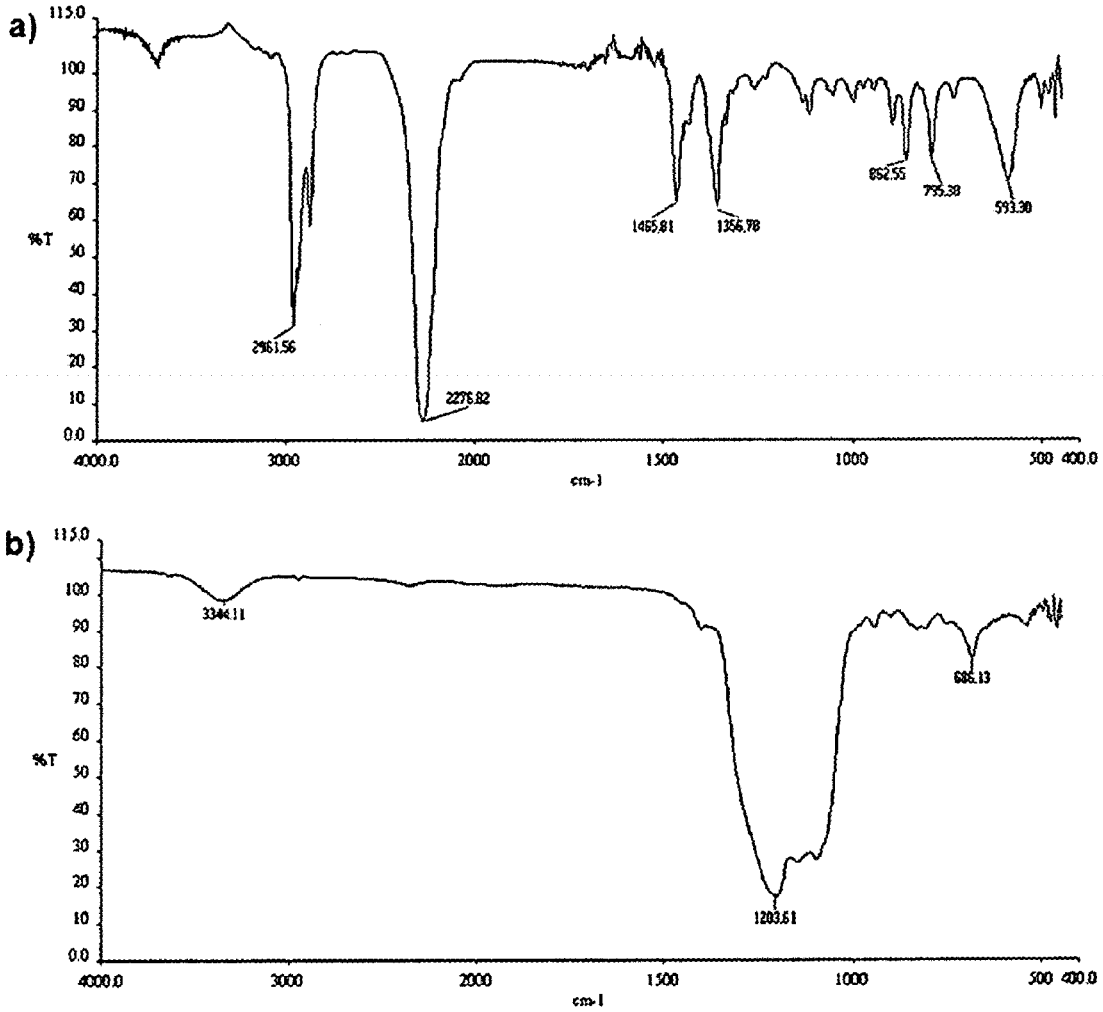
FIG. 26 shows FTIR scans for a) butyl isocyanate and b) the Fluorolink™-D modifier.

Fourier Transform Infrared analysis was run on the new lubricating oils to determine the extent of reaction and ensure complete reaction of starting materials. The scan of butyl isocyanate (FIG. 26(*a*)) shows peaks around 2962 that indicate the presence of butyl group hydrogens. The very large peak at 2277, as well as the rest of the peaks are associated with the isocyanate peak, and the biggest contributors to the scan. The scan of the fluorinated Fluorolink™-D (FIG. 26(*b*)) shows a very large peak at 1200 corresponding to the fluorine carbon stretches, while a broad peak around 3344 shows that an alcohol functional group is available.

Figure 27:
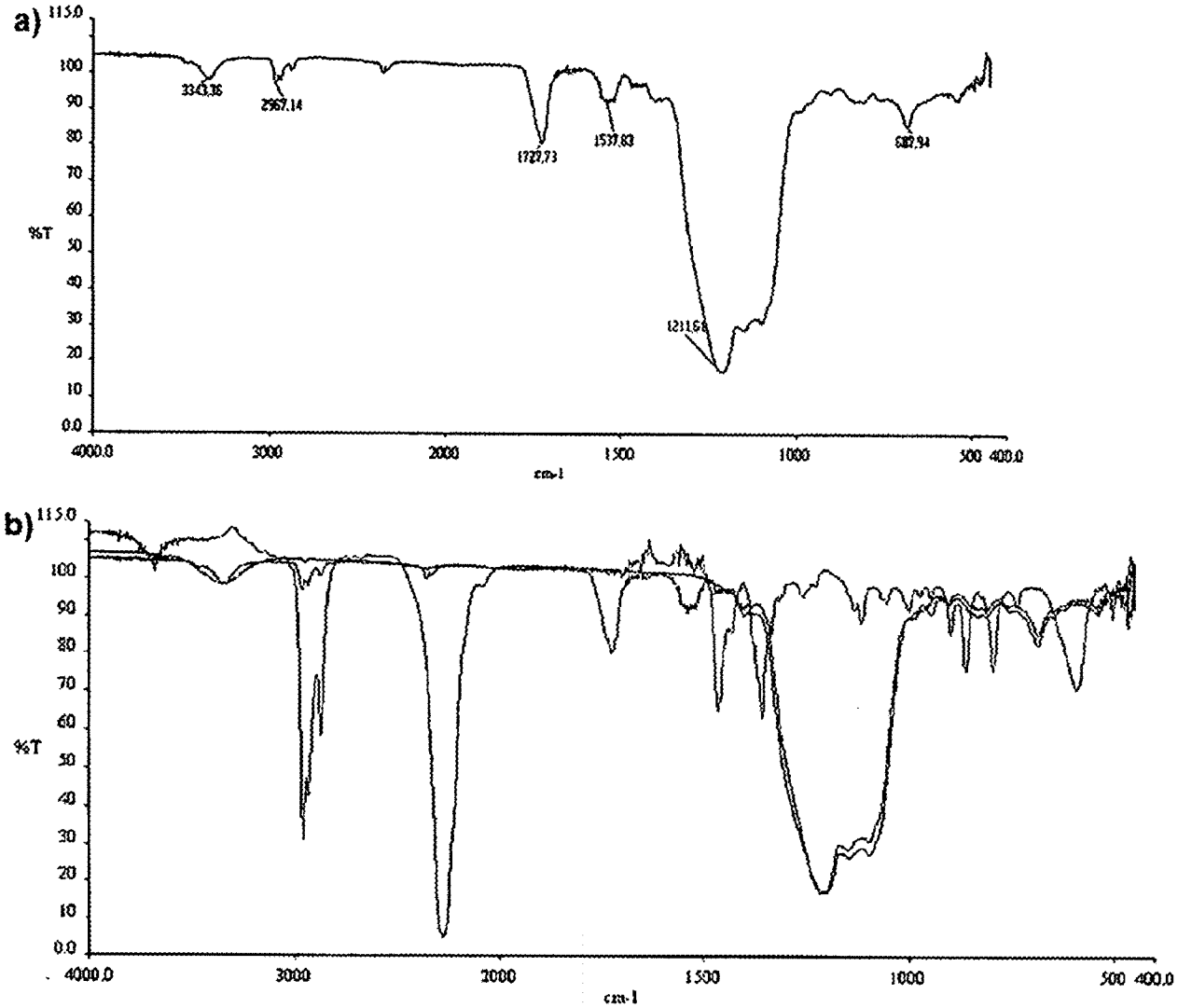
FIG. 27 shows FTIR scans for a) a new base lubricating oil and b) butyl isocyanate, the Fluorolink™-D modifier, and the new base lubricating oil in combination.

The combination of these two chemicals synthetically gives the base lubricant oil. A scan of this oil (FIG. 27(*a*)) is of special interest. First to notice is that the large sharp peak at 2277 is missing completely. This corresponds to the absence of free isocyanate. Based on this absence, it is believed that the reaction has indeed gone to completion without any residual isocyanate or alcohol groups left over to resonate. It is possible to see parts of the chemical starting materials in the final product. Most noticeable is the fluorine to carbon stretch which is still very large and broad at 1212. The butyl hydrogen peaks at 2967 are still seen as well. The tiny doublet at about 2300 is a result of carbon dioxide in the system and the peaks correspond exactly with the carbon dioxide peak in the background. The carbonyl stretch at 1728 along with the N—H stretches at 1538 and 3343 are associated with the urethane linkages holding these starting materials together. FIG. 27(*b*) shows all three scans combined, for comparison.

Example 12

Second Experimental Screening of Selected Formulations

Optimization test matrix #2 consisted of 7 formulations of the novel lubricating oil combined with varied amounts of fillers to create a grease that not only resists washout, but does not off-gas and protects against corrosion. Table 7 below shows the various formulations that were tested. Because the antioxidants and rust inhibitor make up such a small percentage of the formulation these were left out of the formulations to determine effect on the grease. In this second design the component ingredients include the novel lubricating oil (Butyl), a thixotropic filler (silica), a high temperature high lubricating filler (PTFE), and EP additive (Hex BN).

TABLE 7

| Number | Butyl | Silica | PTFE | Hex BN |
|---|---|---|---|---|
| D-1 | 90.00 | 8.00 | 0.00 | 0.50 |
| D-2 | 90.00 | 6.29 | 0.03 | 2.18 |
| D10H-1 | 90.00 | 8.00 | 0.00 | 0.50 |
| D10H-2 | 90.00 | 6.29 | 0.03 | 2.18 |
| E10H-1 | 90.00 | 8.00 | 0.00 | 0.50 |
| E10H-2 | 90.00 | 6.29 | 0.03 | 2.18 |
| Z-DOL-1 | 90.00 | 8.00 | 0.00 | 0.50 |

In the formulations above, the oil to be tested was created using Fluorolink™-D, Fluorolink™-D-10H, Fluorolink™-E10H, and Fomblin® Z-DOL (Solvay Solexis). This oil was then used at 90 percent of the formulation according to the optimization of the first design of experiment. This first design suggested two optimized formulations, and each oil was considered as a part of each formulation. Most of the rest of the formulations were the thixotropic filler fumed silica and the EP additive Hex BN. For washout purposes and initial salt fog and immersion data, the antioxidant/rust inhibition package was left out of this round. Since completing these tests, it was found that this package is indeed helping with the rust and corrosion inhibition, and thus it will be added back in for more corrosion testing.

Figure 28:
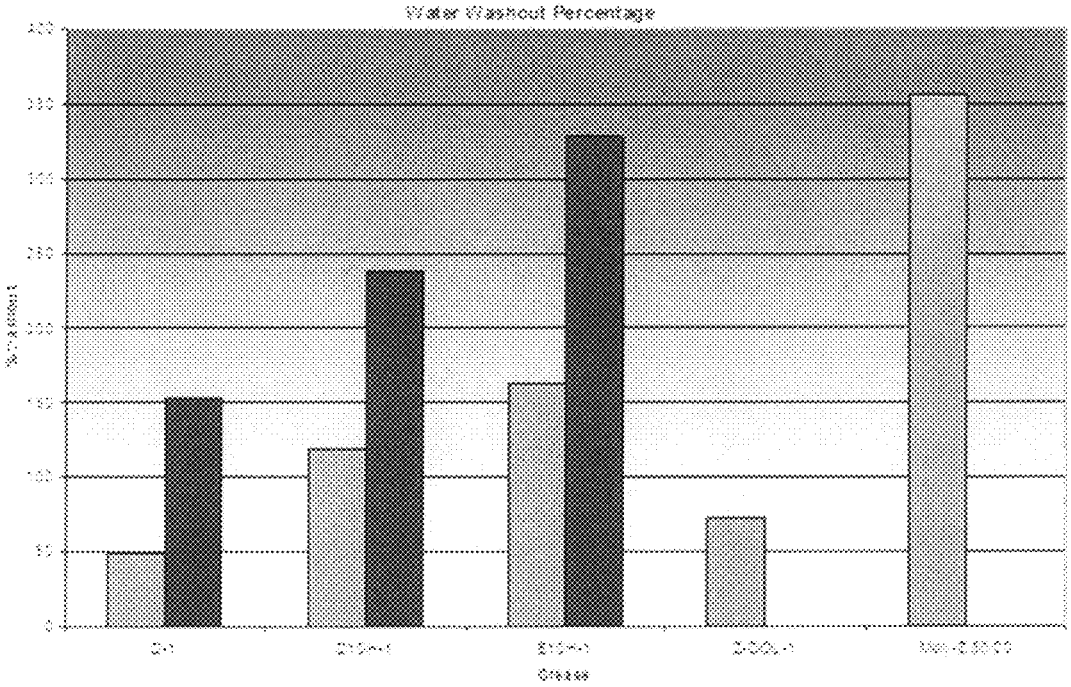
FIG. 28 shows a comparison of water washout values for new grease formulations using Fluorolink™-D, Fluorolink™-D10H, Fluorolink™-E10H, and Fomblin Z-DOL compared to an available grease.

Two new formulations were tested using three new oils to produce seven new grease formulations. These were put through the in-house water washout testing described in Example 3 to see how close to theoretical values they could reproduce. Because of the incredibly low water washout value of only 5% predicted for the first formulation, it was postulated that real life testing would be a bit higher than this theoretical value. Water washout tests concluded this postulation was correct, but water washout values for formulation 1 were all more than double the resistance to washout as the 80/20 Fluorolube/Molykote Z currently used in the field. These values can be compared in FIG. 28.

Figure 29:
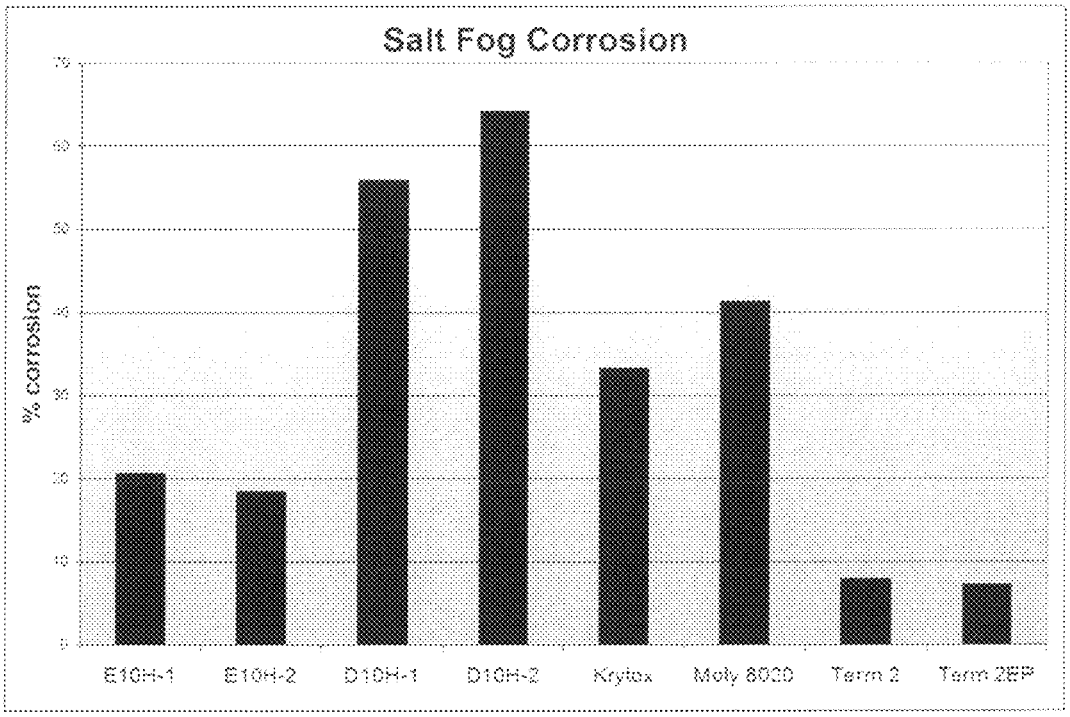
FIG. 29 shows a comparison of salt fog corrosion data for selected new grease formulations compared to available greases.

Salt fog corrosion as described in Example 9 was also performed using some of the new formulations. A comparison of the final grease formulations with the commercial offerings after two weeks in the salt fog cabinet is shown in FIG. 29. The E10H greases offer better corrosion protection from salt spray than that of the Krytox and 8020 Moly greases.

Example 13

Final Formulation Development

Figure 30:
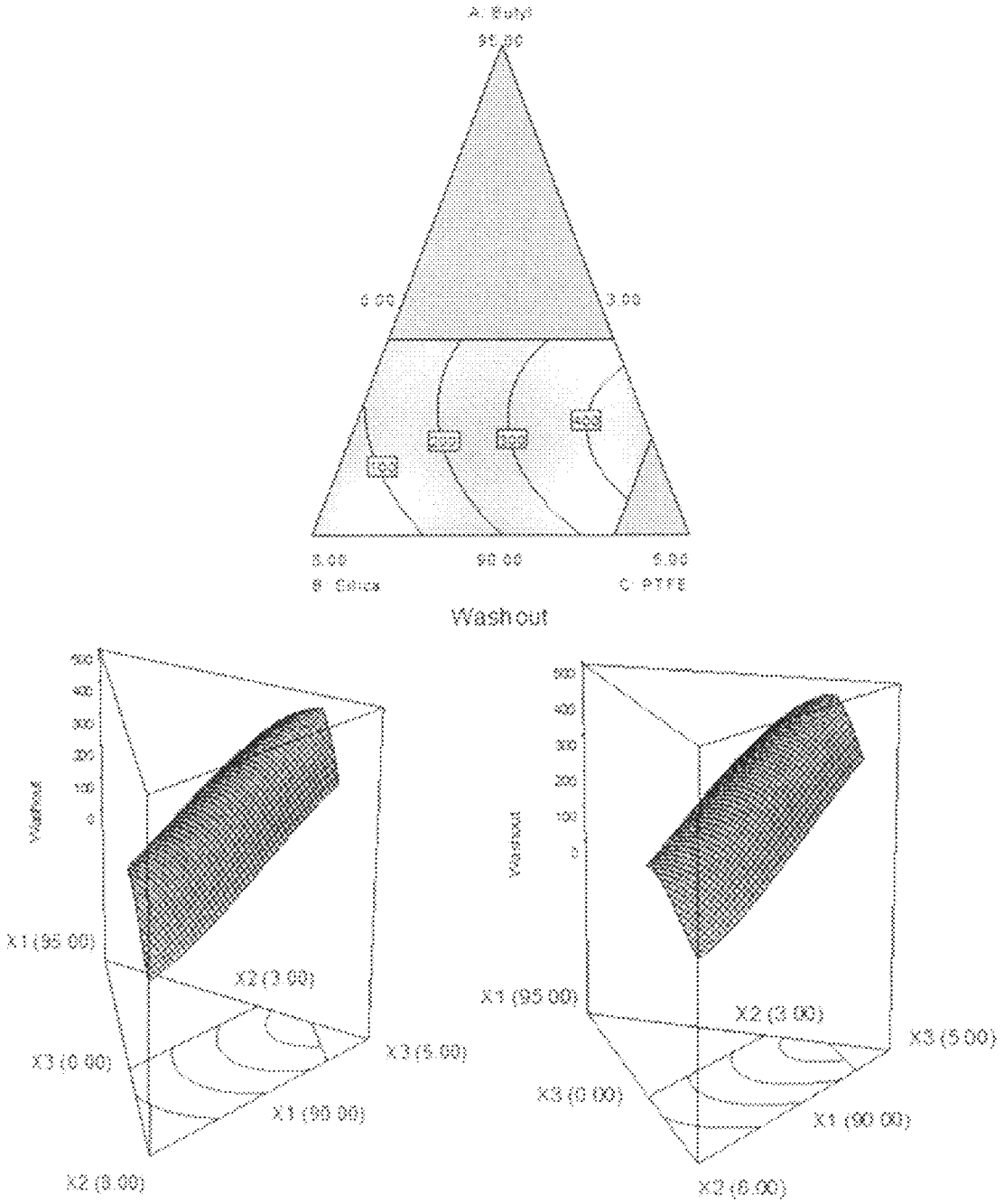
FIG. 30 shows two dimensional and three dimensional representations of experimental design water washout data.
Figure 31:
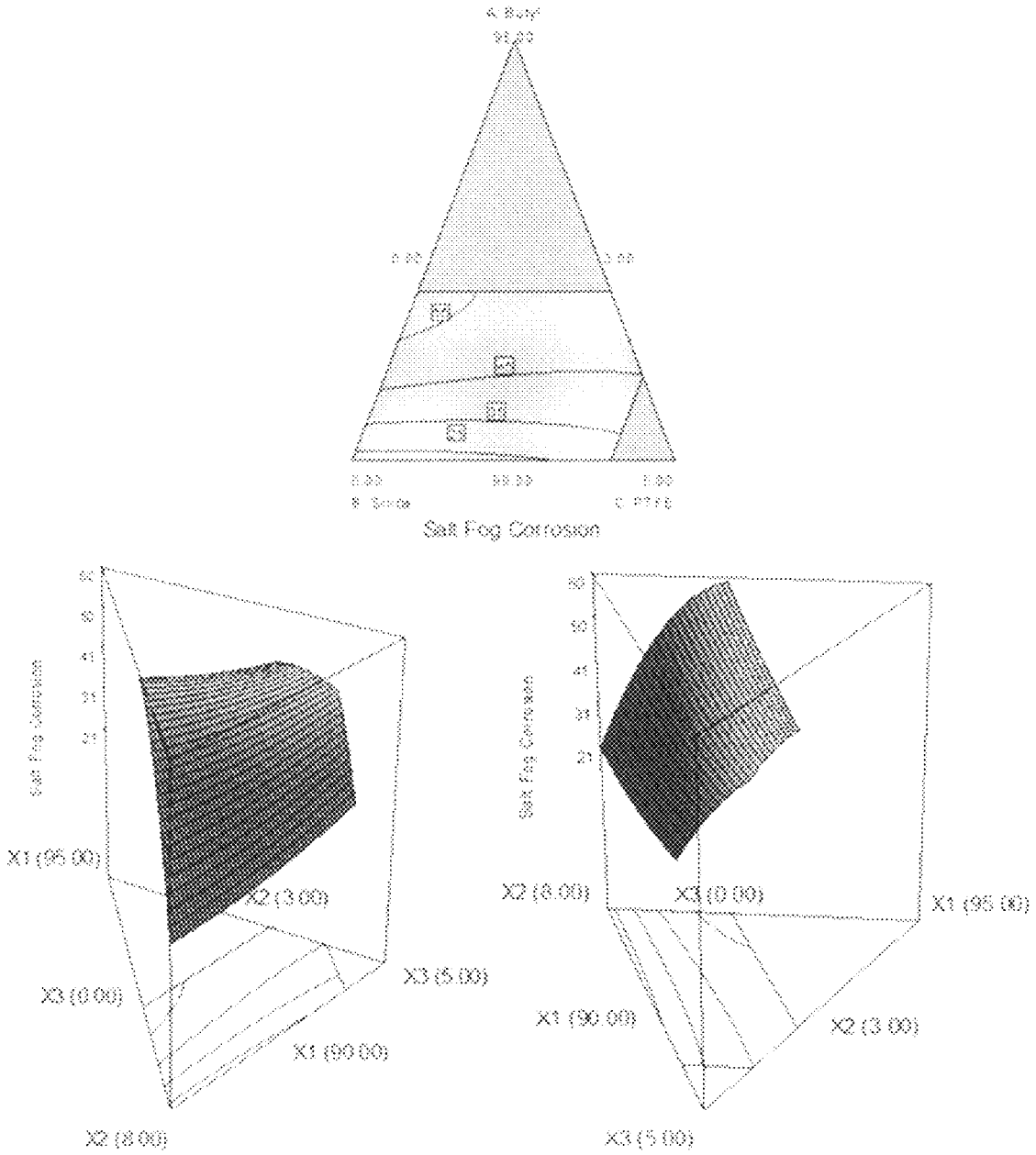
FIG. 31 shows two dimensional and three dimensional representations of experimental design salt fog data.
Figure 32:
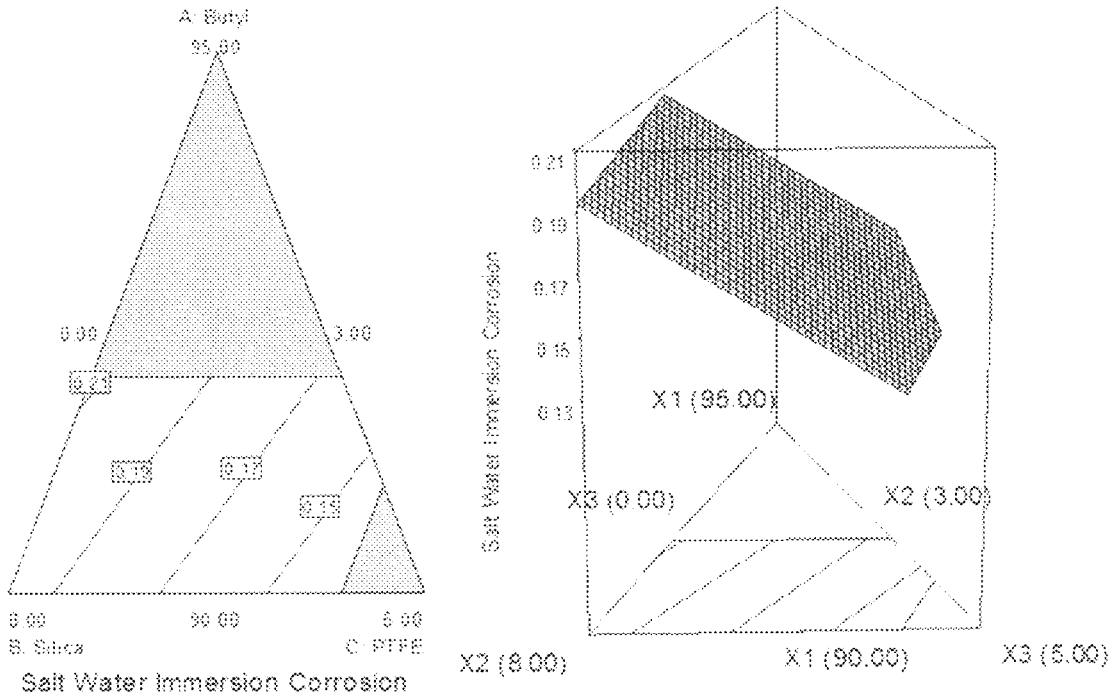
FIG. 32 shows two dimensional and three dimensional representations of experimental design sea water immersion data.

Once all testing was performed for all formulations, this data was input into a computer program and optimized for the best performance. In FIGS. 30-32 are charts of how the three main components affected the three main performance criteria. While disodium sebacate was included in some of the formulations, those formulations were not included below. Disodium sebacate did not increase or decrease the performance of the grease and was left out of the final formulation. In addition, the corrosion package was the same for all formulations as per the provider's suggestion. The charts in FIGS. 30-32 only show results for the optimal amount of EP additive for clarity. Using all the data collected, for all the formulations, a final formulation that was not initially tested was produced to optimize all the performance criteria. This final formulation was then made up and tested to ensure that theoretical optimized results were seen in practice.

The seawater washout data is seen in FIG. 30. As can be seen from both the two dimensional and different angles of the three dimensional charts, seawater washout is a factor of increasing the thixotropic silica filler and decreasing the amount of oil in the grease formulation. The PTFE filler had little real effect on the formulation as far as washout prevention goes. Interesting to note is that the measured space is curved, increasing the amount of grease washed out to a point and then decreasing again as silica is added to the formulation. This might be explained by the presence of PTFE in the formulation, and there may be a threshold effect of the interaction of the PTFE and silica. The bottom left hand corner of the two dimensional chart shows the greatest amount of silica and least amount of water washout. Given only this data, it would be safe to say that the best formulation has the most thixotropic filler.

Doing the same analysis on the salt fog results, seen in FIG. 31, gives slightly different analysis surface spaces. As can be seen in the three dimensional charts, the amount of salt fog corrosion goes down quickly as PTFE and silica fillers are added. Analysis of the corrosion inhibition of adding these fillers is as follows. Addition of a thixotropic filler allows the oil to stay in position on the metallic plate during testing. This produces a physical barrier to the salt spray attempting to oxidize the untreated metal. The PTFE filler further increases the hydrophobicity of the grease, helping to wick away the salt spray before it can attempt to cut through the diver safe grease. In combination, these fillers do better in tandem than they do alone as can be seen in the faster rise of salt fog corrosion as PTFE goes to 0 and the silica is decreased.

Salt water immersion data, in FIG. 32, was less interesting over all. From the data it can be seen that increasing PTFE resulted in slower onset of corrosion. Across the board, this can be seen in a linear fashion. Reduction of the thixotropic silica filler provides only a small difference in the outcome of this test. When standing or immersed in salt water the hydrophobicity of the PTFE is more important than the barrier effects of the thicker greases.

In conclusion, the three main factors that were considered during formulation of a diver safe grease had differing results across the formulation space. Combination of all this data as well as the omitted data used the aforementioned rubrics: water washout being most important, salt fog next important, and immersion least important. Keeping a tight performance criteria of characteristics similar to Termalene®, the computer program was able to compile all the data collected and produce two theoretical optimized formulations which were then tested to ensure a finalized diver safe grease that meets all the requirements.

The most preferred formulation recommended is as follows: 90%-Fluorinated Synthetic Lubricating Oil incorporating the ABA co-polymer based upon Fluorolink E10 shown in FIG. 1; 8%—Hydrophobic Fumed Silica; 0.5%—Boron Nitride EP Additive/1.5%—Corrosion/antioxidant package produced by Vanderbilt, particularly including 0.5% by weight of each of Vanlube® 961, Vanlube® 7723, and Vanlube® 9123.

Figure 33:
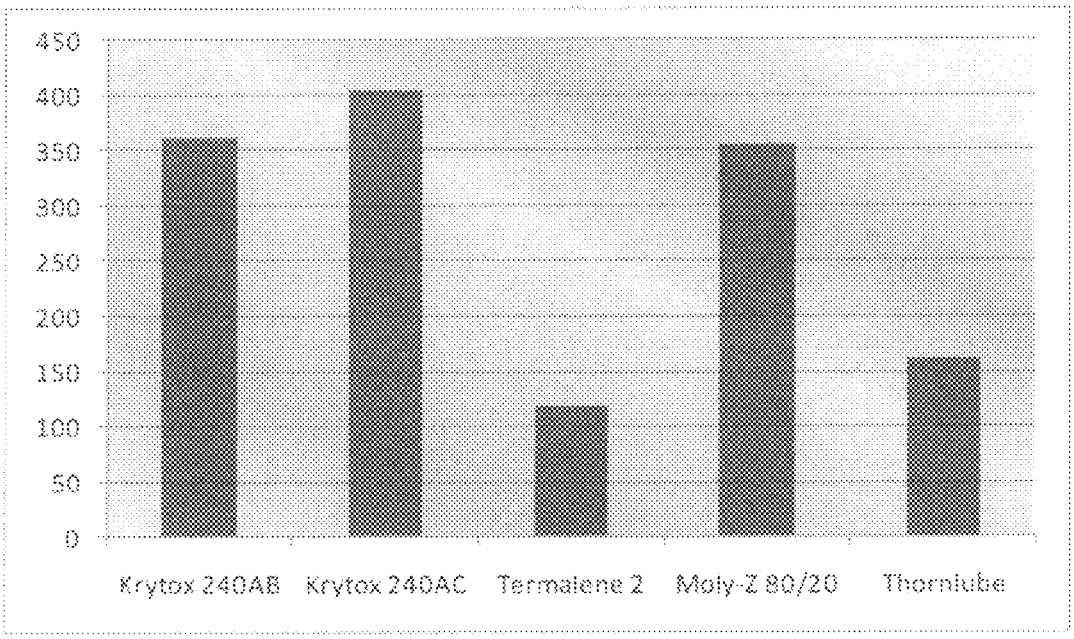
FIG. 33 shows a comparison of lab scale water washout data for available greases and for one preferred optimized formulation of the new greases.

This initial formulation was made up at a quantity of 4 gallons and retested for water washout, salt fog corrosion, and immersion corrosion. This formulation was also sent out for additional testing of material properties and off-gas certification. The results of the comparison study between the final formulation (referred to as Thornlube), Krytox®, Termalene®, and Moly-80/20 are shown in FIG. 33.

Of utmost importance are the water washout characteristics of the new grease formulation. This was accomplished by comparing the new optimized formulation to the commercial greases first at lab scale, and then at full-scale with an actual submarine hatch using the in-house washout testing described in Example 3. As is shown in from FIG. 33, the preferred formulation has favorable washout characteristics similar to those of Termalene®. In all the following charts, the lower the number the better for that characteristic. The preferred formulation is very favorable compared to the Krytox® and Moly-80/20, and not much different from the Termalene® which shows the most favorable water washout characteristics. This labscale quantitative test shows the amount of area the grease spreads when blasted by a high volume of water in a direction normal to the plane of the grease. The higher the number, the more area was covered by the same starting amount of grease. By looking at this test, it is possible to predict how susceptible a grease is to water washout. The preferred formulation (Thornlube) behaved very favorably in this test.

Figure 34:
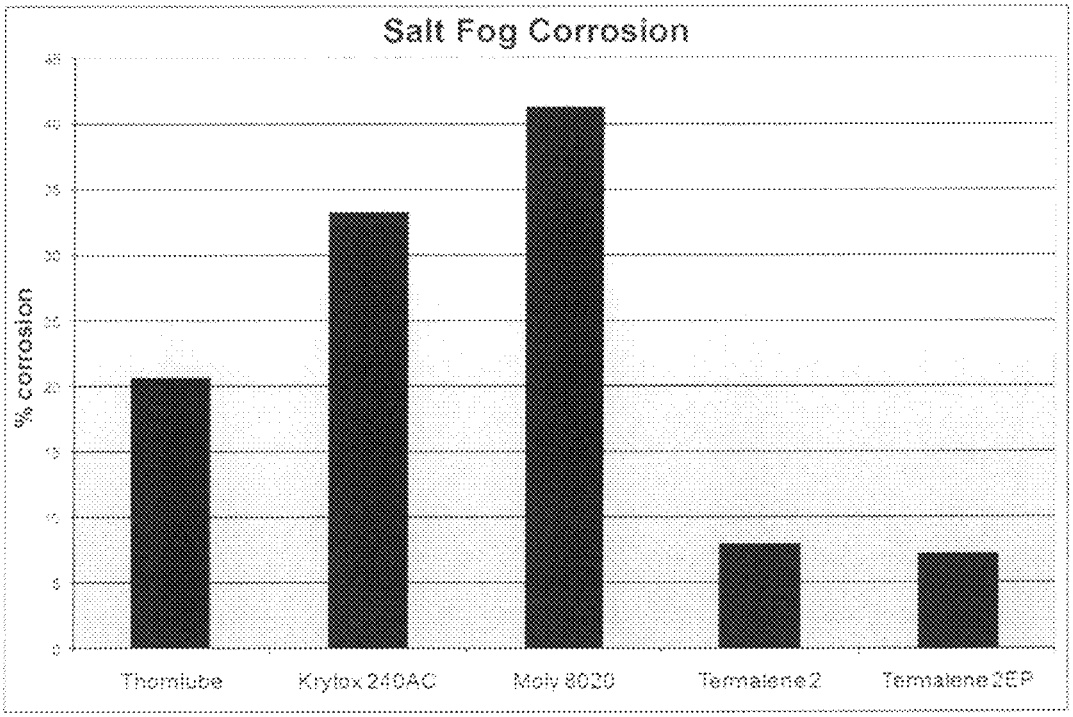
FIG. 34 shows a comparison of salt fog data for available greases and for one preferred optimized formulation of the new greases.

Salt fog corrosion testing as described in Example 9 was conducted on untreated cold rolled steel for the period of two weeks. The panels were coated with grease on both sides, and after the test, they were scanned into a computer and analyzed using photo manipulation software to determine a quantitative percent of the surface covered in corrosion. As can be seen from FIG. 34, the preferred formulation prevented more corrosion over this period than either Krytox® or Moly-Z 80/20.

Figure 35:
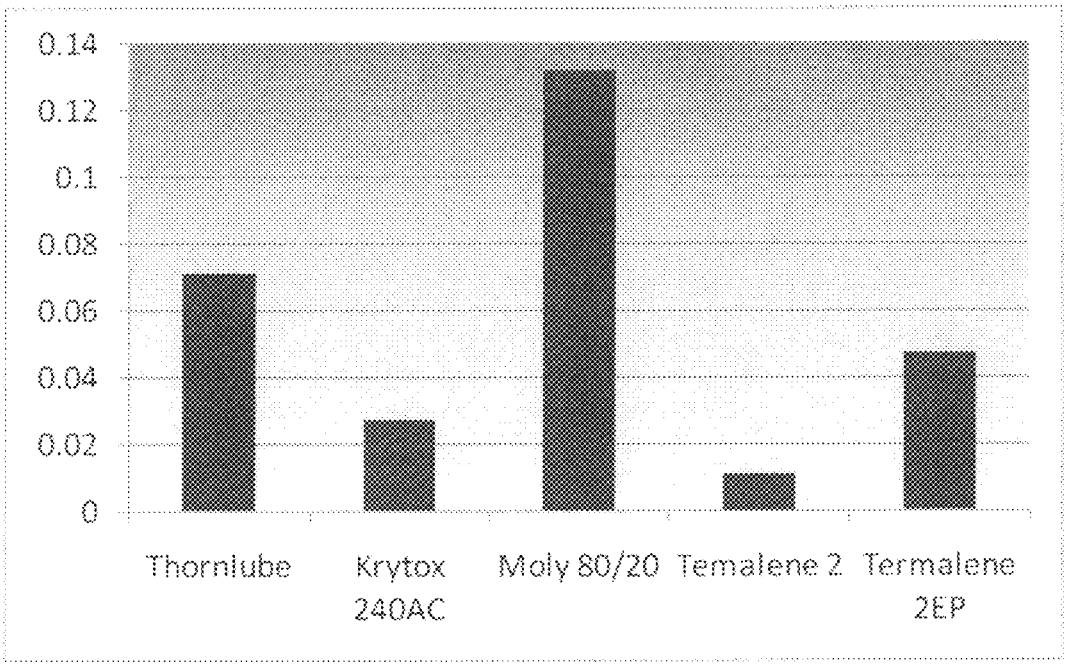
FIG. 35 shows a comparison of salt water immersion data for available greases and for one preferred optimized formulation of the new greases.

Salt water immersion studies of the optimized formulation and comparison greases according to Example 10 were conducted over a period of 5 weeks. During this time, pictures were analyzed of each grease, and a chart of increased corrosion over time was created. The slope of this chart gives an indication of the speed at which a partially immersed sample will corrode when covered in grease and exposed to seawater. None of the greases prevented corrosion completely, as seen in FIG. 35, and the preferred formulation (Thornlube) performed as well as any of the commercial greases used in the field today.

Example 14

Additional Performance Testing

Independent performance and qualification testing will be performed by Petro-Lube Test Labs, an independent facility. The tests to be performed include those in Table 8 below.

TABLE 8

| Standard Test Method | Test | Purpose of the Test | Test Results |
|---|---|---|---|
| ASTM D-1403 | Small Scale Cone Penetration | ¼ Scale Penetration, Unworked and Worked | Unworked - 244 Worked - 254 |
| ASTM D-2595 | Evaporation Loss @ 22 hours | Measurement of permanence | 0.70% |
| ASTM D-942 | Pressure Vessel Oxidation @ 100 hours | Measure the net change in pressure resulting from consumption of oxygen by oxidation and gain in pressure due to formation of volatile oxidation by-products. | 2.0 psi drop |
| ASTM D-2266 | Four Ball Wear of Grease | Used to determine the relative wear-preventing properties of greases under the test conditions. | 0.56 mm |
| ASTM D-2596 | Load Wear Index of Grease | Determination of the load-carrying properties of lubricating greases. | 95.71 |
| ASTM D-1478 | Low Temperature Torque | Determination of the starting and running torques at low temperatures (below −20° C. (0° F.)). | Starting Torque 9024 g-cm 1 Hr Running Torque 732 g-cm |
| FTM-5309 | Copper Corrosion of Grease | Detection of Copper Corrosion from Petroleum Products by the Copper Strip Tarnish Test | Exposed 3B Immersed 4A |
| FTM-321 | Oil Separation | Wire Cone Method | 4.21% |
| FTM-5415 | Resistance of Grease to Aqueous Solutions | 1 week exposed to water and water/ethanol | 0% dis-integration |
| FTM-3005 | Dirt Count of Greases | the number of foreign particles between 25 and 75 microns per milliliter of sample, and particles greater than 75 microns per milliliter of sample. | 25-74μ - 38/cc +75μ - 0/cc |

A detailed specification that includes all of the information above, as well as information on the synthesis of the oil, and creation of the grease was compiled and submitted. This document also included quality parameters and vendor specifications, as well as application recommendations.

Example 15

Full Scale Hatch Testing

Generally, with the locking ring removed, the amount of grease required to put a light even coat of grease on hatch steel buttress threads so there is not a lot of excess grease being squeezed out when the locking ring is fully installed should be determined. Any grease can be used to determine the required volume of grease needed. This same measured volume of grease will then be used for each grease sample. Applying a thin even coat of grease on all surfaces of the steel buttress threads each time should be more consistent than using the grease fittings. The locking ring is removed to determine that uniform greasing is on both hatch and locking ring threads. For each initial test after installation of locking ring with grease, the locking ring is removed and photographed (360 degrees) to analyze initial grease distribution on both hatch and LR threads.

In more detail, the steps performed were as follows:

1) Locking ring was removed; locking ring and hatch buttress threads were cleaned with water and isopropyl alcohol, and it was ensured that all old grease and any debris was removed, leaving clean dry metal on both hatch and locking ring threads.

2) Locking ring was reinstalled. It was ensured that the locking ring was installed to the same position for the pumping of grease (closed and locked position). The measured volume of grease was used to put a light even coat of grease onto hatch cover buttress threads. In this test, the measured amount was 10 pumps on each grease fitting followed by a shifting of the locking ring 30 degrees, followed by 5 additional pumps of grease to ensure an even coating of grease on the locking ring and hatch cover with minimal excess. The hatch was in proper locked position. This position will be used in every future test in which the locking ring is in place.

3) The hatch was inserted into the test rig, and the test time was documented. It was ensured that each test has the same test time, to be consistent 8 hours). The test hatch was strapped down to the test chamber so it could not move during testing, until the test is complete and the water is drained from the chamber.

4) The locking ring was removed.

5) Pictures were taken of the grease coated hatch and LR buttress threads (360 degrees each). Subjective and objective evaluation metrics were developed. Examples of objective inspections were wet film thickness, area where grease was washed away, and others.

6) A first evaluation was done without seawater to ensure the necessity of producing many gallons of seawater for every test.

7) The test was carried out in a water tank currently used for soil erosion testing. This tank had a wench pulley system rated for half a ton which was used to hoist the hatch into the tank and rest it at the bottom. This tank is large enough to hold the hatch with room to spare. Above the hatch location, was suspended a stirring mechanism, and this agitated the water throughout the test.

8) The tank was filled with 34.5 inches of water for each test. The agitator spun at 25 RPM for an average of 2 knots of turbulent water flow over the hatch.

9) After 8 hours the water was drained, and the hatch was allowed to dry before inspecting for grease washout.

10) Inspection included another set of pictures for comparison as well as visual notes on things that might not appear in pictures of the locking ring and hatch cover.

11) The test was repeated without the locking ring in position as an accelerated washout test.

Example 16

Off-Gassing Certification Testing

The System Certification Procedures and Criteria Manual for Deep Submergence Systems describes the necessary methods for testing the off-gassing of any new product meant for deep submergence systems. General Dynamics Electric Boat is certified to carry out testing of new materials for NAVSEA. In the testing of new materials, they utilize a very similar system to the one used in house for testing of off-gassing. To pass certification there are a number of parameters and limits that must be passed. Once determined, these parameters are looked at by authorities in NAVSEA for final approval of the material for submergence systems.

The preferred formulation tested by General Dynamics Electric Boat was approved by NAVSEA after completion of the off-gas testing analysis because the surface equivalent values for all off-gassed compounds were within allowable limits where limits were established. For those compounds where limits were not established, the results were reviewed and found to be acceptable. The detectable odor was also reviewed and determined not to be objectionable.

Example 17

Preparation of Preferred Formulation

The materials used to prepare 100 pounds (about 7.5 gallons) of the preferred grease formulation are as follows:

n-Butyl Isocyanate—CAS #-11-36-4
- Supplier—Lanxess Corporation
  - Advanced Industrial Intermediates
  - Farm Road 1006
  - Orange, Tex. 77631

Fluorolink™ E-10H—CAS #-162492-15-1
- Supplier—Solvay Solexis, Inc.
  - 10 Leonard Lane
  - West Deptford, N.J. 08086

Aerosil R 202—CAS #-67762-90-7
- Supplier—Evonik Degussa Corporation
  - 379 Interpace Parkway
  - Parsippany, N.J. 07054

BN AC6041—CAS #-10043-11-5 >95-99%
- CAS #-1303-86-2<1-5%
- Supplier—Momentive Performance Materials Quartz, Inc.
  - 22557 West Lunn Road
  - Strongsville, Ohio 44149

Vanlube 961—CAS #-184378-08-3
- a liquid, ashless antioxidant for use in oils and greases of various types Vanlube 7723—CAS #-10254-57-6
- a liquid, ashless high temperature antioxidant that aids in extreme pressure applications Vanlube 9123—NJTSR No. 800983-5100P
- a liquid, ashless anti-wear rust inhibitor for use in oils and greases of various types
- Supplier—R.T. Vanderbilt Company, Inc.
  - 30 Winfield Street
  - Norwalk, Conn. 06855

DABCO 33LV—CAS #-280-57-9
- Supplier—Sigma-Aldrich
  - 3050 Spruce St.
  - St. Louis, Mo. 63103

The lubrication oil was synthesized as follows. In a clean, dry, and nitrogen filled reactor, 81 pounds of Fluorolink™ E10H was combined with 9 pounds n-Butyl Isocyanate and 0.11 pounds of DABCO 33LV initiator. The mixture was heated to 70° C. while stirring vigorously. The reaction is slow and can take more than 8 hours. It is considered complete when the isocyanate no longer is detectable in the solution. This is determined by a quick titration, as described below.

First, a solution of dibutylamine (DBA) in toluene was prepared by mixing 60 ml (11.11%) of DBA with 480 ml (88.88%) of toluene. (0.65936N) Then, 0.1 g of bromophenol blue was dissolved in 100 ml of methanol. Dilute sodium hydroxide (0.1M) was added dropwise with stirring until the solution is blue. Approximately 2-3 g of each product was then weighed accurately into each of 3 flasks (3 replicates). 50 ml of the DBA solution was pipetted into each of the sample flasks and into 3 further flasks to serve as blanks. [3 blanks+3 replicates per each product]. The flasks were swirled to mix their contents. Gentle warming on a hot plate may be needed to dissolve the products and speed up the completion of the reaction. 100 ml of isopropanol and 3-4 drops of the bromophenol blue solution was added to each of the flasks. The contents of the flasks were titrated against 1 molar hydrochloric acid. The end point was a color change from blue to pale yellow. Blank titres should agree to within 0.1 ml. If not the titration should be repeated. The blank titre should be about 32 ml. The percentage NCO in the samples should be calculated as follows:

$$\%\,NCO = \frac{HClmolarity \times (meanblank - titre) \times 4.2}{sampleweight}$$

When the % NCO is zero, the reaction is complete, and the isocyanate is no longer present. This completes the synthesis of the lubrication oil.

The lubrication oil synthesized makes up 90% by weight of the final grease formulation. To the lubrication oil, 0.5 pounds of each of the three Vanlube products was added. The solution will become slightly cloudy, so it must be stirred thoroughly.

The lubrication oil was then transferred to a combination mixer to impart medium shear to the liquid at relatively low speed. 0.5 pounds of the BN AC6041 was added to the oil, and it was mixed thoroughly until the powder was fully wetted out by the lubrication oil.

At this point the only remaining ingredient should be the Aerosil 8202 silica powder. This powder is not very dense, and adding 8 pounds is a very large volume that may not fit in the mixing vessel all at once. This was added slowly over time while mechanically stirring the lubrication oil. The oil will become more and more dense, and slowly become opaque changing into a homogenous grease as the silica is added.

To ensure that the grease made is a physical match for the preferred formulation, certain tests must be repeated. The results of these tests should be within tolerance of those that were conducted at the conclusion of the formulation testing phase of the product development. Upon completion of the grease, a one pound sample should be taken from the batch to be tested immediately to determine if it conforms to the following properties.

| | | |
|---|---|---|
| ASTM D-1475 | Density | 13.1 lb/gal |
| ASTM D-1403 | Worked Penetration, ¼ Scale | 270-315 |
| ASTM D-2595 | Evaporation Loss, 22 hrs. @ 93° C. | 7% maximum |
| ASTM D-2596 | Load Wear Index | 50 minimum |
| FTM-321 | Oil Separation | 6% maximum |
| FTM-5415 | Resistance to Aqueous Solution 168 hrs @ RT | 0% disintegration |
| FTM-3005 | Dirt Count 25 to 74μ | 50/cc maximum |
| | +75μ | 0/cc |

What is claimed is:

1. A grease formulation for use in underwater applications, comprising:

a lubricating oil comprising a co-polymer of a hydrocarbon isocyanate and a fluorocarbon alcohol or a hydroxyl terminated perfluoropolyether;

fumed silica;

boron nitride; and one or more corrosion or oxidation inhibitors, wherein the grease formulation is resistant to water washout and does not off-gas toxic compounds.

2. The grease formulation of claim 1, wherein the lubricating oil comprises a co-polymer of n-butyl isocyanate and perfluoropolyether-ethoxylated dialcohol.

3. The grease formulation of claim 1, wherein the lubricating oil comprises a co-polymer selected from:

an ABA copolymer having the structure of

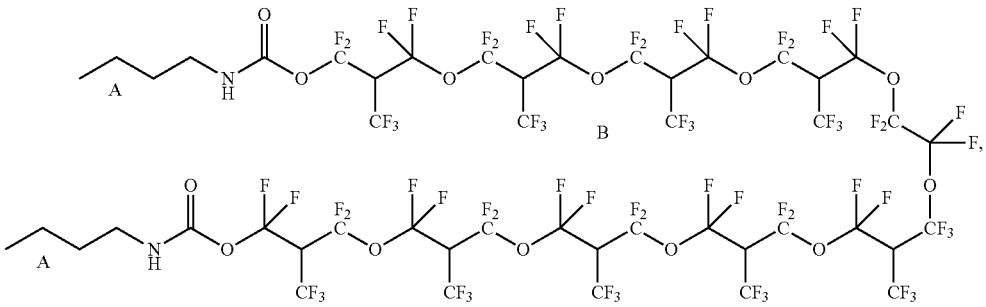

and an ABA copolymer having the structure of

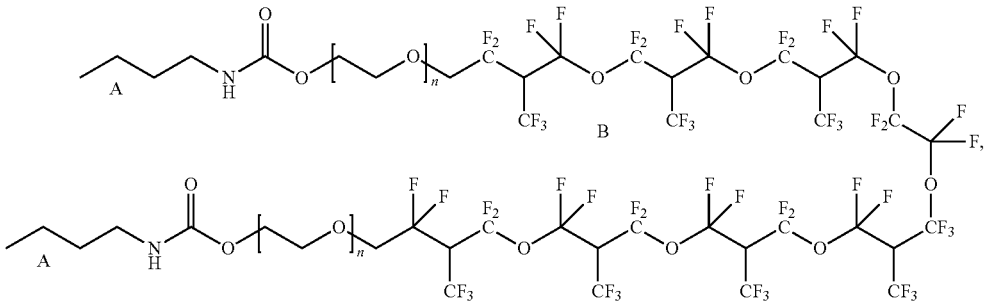

wherein n is an integer from 1 to 2.

4. The grease formulation of claim 1, wherein the one or more corrosion inhibitors comprise antioxidants, anti-wear rust inhibitors, or mixtures thereof.

5. The grease formulation of claim 1, further comprising one or more polyurethane initiators.

6. The grease formulation of claim 1, wherein the lubricating oil is about 80-95% by weight of the grease formulation, the fumed silica is about 5-10% by weight of the grease formulation, the boron nitride is about 0.1-1% by weight of the grease formulation, and the one or more corrosion or oxidation inhibitors are about 0.1-1.5% total by weight of the grease formulation.

7. A grease formulation for use in underwater applications, comprising:

about 90% by weight of a lubricating oil comprising a co-polymer having the structure

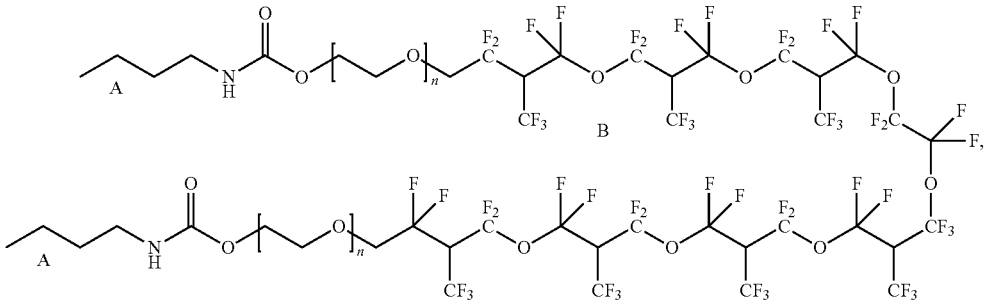

wherein n is an integer from 1 to 2;

about 8% by weight of fumed silica;

about 0.5% by weight of boron nitride; and about 1.5% by weight of one or more corrosion or oxidation inhibitors, wherein the grease formulation is resistant to water washout and does not off-gas toxic compounds.

8. A method for lubricating actuated parts in for use in underwater applications, comprising:

applying a grease formulation to the actuated parts, wherein the grease formulation comprises a lubricating oil comprising a co-polymer of a hydrocarbon isocyanate and a fluorocarbon alcohol or a hydroxyl terminated perfluoropolyether, fumed silica, boron nitride, and one or more corrosion inhibitors; and immersing the parts in water, wherein the grease formulation is resistant to water washout and does not off-gas toxic compounds.

9. The method of claim 8, wherein the lubricating oil comprises a co-polymer of n-butyl isocyanate and perfluoropolyether-ethoxylated dialcohol.

10. The method of claim 8, wherein the lubricating oil comprises a co-polymer selected from:

an ABA copolymer having the structure of

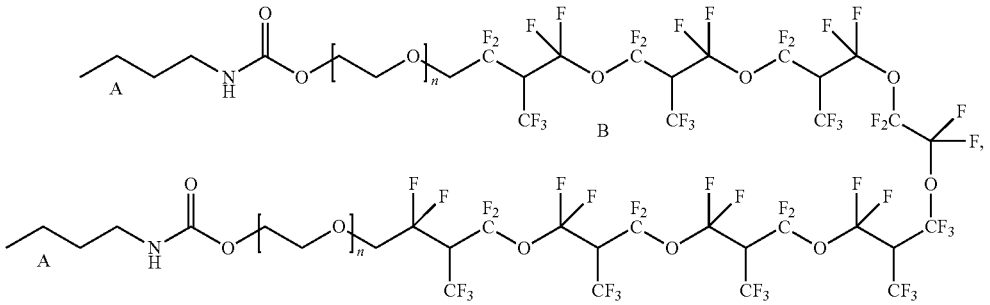

wherein n is an integer from 1 to 2, and an ABA copolymer having the structure of

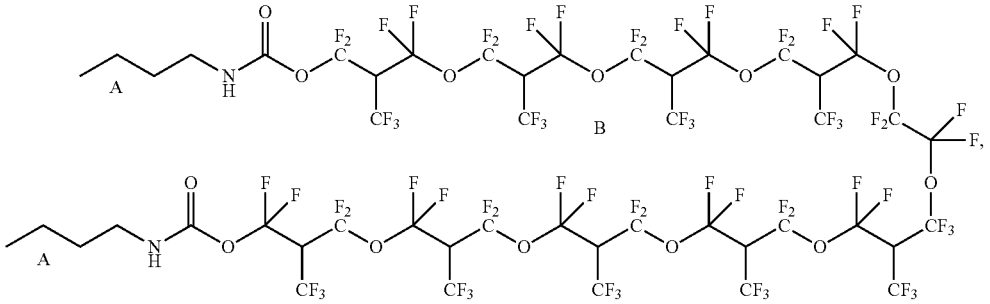

11. The method of claim 8, wherein the one or more corrosion inhibitors comprise antioxidants, anti-wear rust inhibitors, or mixtures thereof.

12. The method of claim 8, further comprising one or more polyurethane initiators.

13. The method of claim 8, wherein the lubricating oil is about 80-95% by weight of the grease formulation, the fumed silica is about 5-10% by weight of the grease formulation, the boron nitride is about 0.1-1% by weight of the grease formulation, and the one or more corrosion inhibitors are about 0.1-1.5% by weight of the grease formulation.

14. The method of claim 8, wherein the water is seawater.

15. The method of claim 8, wherein the actuated parts are parts of a submarine or diving apparatus.

16. A method for lubricating actuated parts in for use in underwater applications, comprising:

applying a grease formulation to the actuated parts, wherein the grease formulation comprises about 90% by weight of a lubricating oil comprising a co-polymer having the structure

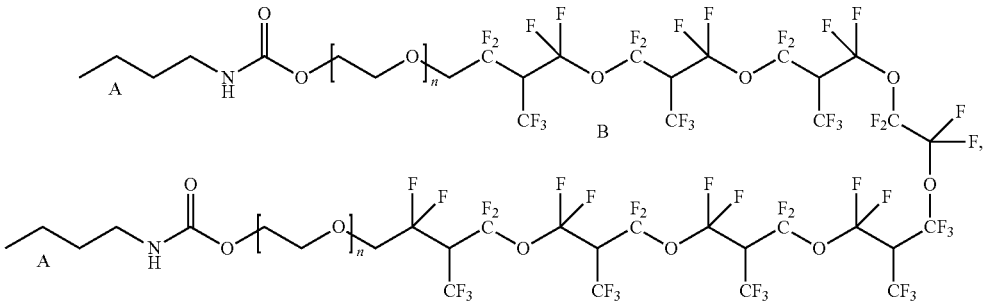

wherein n is an integer from 1 to 2, about 8% by weight of fumed silica, about 0.5% by weight of boron nitride, and about 1.5% by weight of one or more corrosion inhibitors; and immersing the parts in water, wherein the grease formulation is resistant to water washout and does not off-gas toxic compounds.

* * * * *